US007074286B2

(12) United States Patent
Klueh et al.

(10) Patent No.: US 7,074,286 B2
(45) Date of Patent: Jul. 11, 2006

(54) WROUGHT CR—W—V BAINITIC/FERRITIC STEEL COMPOSITIONS

(75) Inventors: Ronald L. Klueh, Knoxville, TN (US); Philip J. Maziasz, Oak Ridge, TN (US); Vinod Kumar Sikka, Oak Ridge, TN (US); Michael L. Santella, Knoxville, TN (US); Sudarsanam Suresh Babu, Knoxville, TN (US); Maan H. Jawad, St. Louis, MO (US)

(73) Assignee: UT-Battelle, LLC, Oak Ridge, TN (US)

( * ) Notice: Subject to any disclaimer, the term of this patent is extended or adjusted under 35 U.S.C. 154(b) by 31 days.

(21) Appl. No.: 10/323,194

(22) Filed: Dec. 18, 2002

(65) Prior Publication Data

US 2004/0118490 A1 Jun. 24, 2004

(51) Int. Cl.
*C22C 38/26* (2006.01)
*C22C 38/38* (2006.01)

(52) U.S. Cl. ..... 148/660; 148/334; 420/110; 420/111; 420/114

(58) Field of Classification Search ..... 148/333, 148/334, 335, 660, 661, 663, 651, 654, 653; 420/111, 114, 10
See application file for complete search history.

(56) References Cited

U.S. PATENT DOCUMENTS

| | | | | |
|---|---|---|---|---|
| 5,292,384 | A | 3/1994 | Klueh et al. | |
| 5,407,635 | A * | 4/1995 | Iseda et al. | 420/110 |
| 5,695,576 | A * | 12/1997 | Beguinot | 148/328 |
| 5,746,843 | A * | 5/1998 | Miyata et al. | 148/335 |
| 5,814,274 | A * | 9/1998 | Komai et al. | 420/106 |
| 6,254,697 | B1 | 7/2001 | Tashiro et al. | |
| 6,379,611 | B1 * | 4/2002 | Komai et al. | 420/106 |
| 6,514,359 | B1 * | 2/2003 | Kawano | 148/328 |
| 6,821,360 | B1 * | 11/2004 | Ishii et al. | 148/333 |
| 2003/0116240 | A1 * | 6/2003 | Fujita et al. | 148/639 |

* cited by examiner

*Primary Examiner*—George Wyszomierski
(74) *Attorney, Agent, or Firm*—Akerman Senterfitt

(57) ABSTRACT

A high-strength, high-toughness steel alloy includes, generally, about 2.5% to about 4% chromium, about 1.5% to about 3.5% tungsten, about 0.1% to about 0.5% vanadium, and about 0.05% to 0.25% carbon with the balance iron, wherein the percentages are by total weight of the composition, wherein the alloy is heated to an austenitizing temperature and then cooled to produce an austenite transformation product.

28 Claims, 15 Drawing Sheets

WROUGHT CR—W—V BAINITIC/FERRITIC STEEL COMPOSITIONS

The United States Government has rights in this invention pursuant to contract no. DE-AC05-00OR22725 between the United States Department of Energy and UT-Battelle, LLC.

FIELD OF THE INVENTION

The present invention relates generally to wrought ferritic steel alloys and, more specifically, to high-strength, high-toughness wrought Cr—W—V ferritic steel alloys having a bainite microstructure achieved through the alloy composition and by controlling the cooling rate from an austenitizing temperature.

BACKGROUND OF THE INVENTION

Cr—W—V bainitic/ferritic steel compositions are of interest for high-strength and high-toughness applications. Please see U.S. Pat. No. 5,292,384 issued on Mar. 8, 1994 to Ronald L. Klueh and Philip J. Maziasz, entitled "Cr—W—V bainitic/ferritic steel with improved strength and toughness and method of making", the entire disclosure of which is incorporated herein by reference.

There is usually a trade off in strength and toughness for most engineering materials: improved toughness usually comes at the expense of strength. The new ferritic steels have a bainite microstructure, and bainitic steels are generally used in the normalized-and-tempered or quenched-and-tempered conditions. Normalizing involves a high-temperature austenitizing anneal above the $A_{C3}$ temperature (the temperature where all ferrite transforms to austenite on heating) and an air cool, and quenching involves the austenitization anneal and a water quench; tempering involves a lower-temperature anneal—below the $A_{C1}$ temperature (the temperature at which ferrite begins to transform to austenite on heating). Tempering at higher temperatures and/or longer times at a given temperature improves the toughness at the expense of strength.

The objective, therefore, is to develop steels with optimized strength and toughness. Ideally, such steels would develop a low ductile-brittle transition temperature (DBTT) and high upper-shelf energy (USE) with minimal tempering (i.e., tempering at a low temperature or for a short time), thus allowing for high-strength and toughness. An ideal bainitic steel composition is one that can be produced by normalizing (air cooling) or quenching in water or other cooling media and then could be used without tempering. Economic considerations have made such steels a goal of the steel industry.

Early work on Fe-2.25Cr-2.0W-0.25V-0.1C (2/1;4Cr-2WV) demonstrated that by a proper heat treatment of Fe—Cr—W—V—C steels, it was possible to produce two different bainitic microstructures, shown in FIGS. 1*a* and 1*b*, in the normalized-and-tempered condition. It was discovered that the normalized-and-tempered microstructures developed during tempering were from two different bainite microstructures that formed during normalization; they were: carbide-free acicular bainite and granular bainite. The large blocky carbide particles that precipitate in the granular bainite are probably responsible for the inferior toughness of this steel.

Carbide-free acicular bainite consists of thin sub-grains containing a high dislocation density with an acicular appearance, shown in FIG. 2*a*. Granular bainite has an equiaxed appearance with bainitic ferrite regions of high dislocation density and dark regions, shown in FIG. 2*b*. The dark regions have been determined to be martensite and retained austenite and have been called "M-A islands" (martensite-austenite islands). They form because during the formation of the bainitic ferrite, carbon is rejected into the untransformed austenite. The last of the high-carbon austenite regions are unable to transform to bainite during cooling. Therefore, parts of these high-carbon regions transform to martensite when the steel is cooled below the martensite start ($M_s$) temperature. The remainder is present as retained austenite.

Whether carbide-free acicular bainite or granular bainite form during the normalization heat treatment depends on the cooling rate from the austenitization temperature. The difference in microstructure can be explained using a continuous-cooling diagram, shown in FIG. 3 (see for example, L. J. Habraken and M. Economopoulos, *Transformation and Hardenability in Steels*, Climax-Molybdenum Company, Ann Arbor, Mich., 1967, p. 69, R. L. Klueh and A. M. Nasreldin, *Met. Trans.* 18A, 1987, p. 1279; R. L. Klueh, D. J. Alexander, and P. J. Maziasz, *Met. Trans.* 28A, 1997, p. 335). If the steel is cooled rapidly enough to pass through Zone I in FIG. 3, acicular bainite forms; if cooled more slowly through Zone II, granular bainite forms.

Mechanical properties studies of the different bainites indicated that the acicular bainite had superior strength and toughness compared to the granular bainite. As an alternative to an increased cooling rate to achieve the favorable properties, it was concluded the same effect could be obtained if the hardenability was increased. To increase hardenability, the chromium and tungsten compositions were increased, and acicular bainite could then be produced in a 3Cr-2WV and 3Cr-3WV steel, whereas granular bainite was always produced for similar heat treatment conditions in the 2¼Cr-2WV steel, as shown in FIG. 4.

OBJECTS OF THE INVENTION

Accordingly, objectives of the present invention include provision of wrought Cr—W—V bainitic/ferritic steel compositions that do not require a temper and/or post-weld heat treatment prior to use. Further and other objectives of the present invention will become apparent from the description contained herein.

SUMMARY OF THE INVENTION

In accordance with one aspect of the present invention, the foregoing and other objects are achieved by a high-strength, high-toughness wrought steel composition that includes about 2.5% to about 4% chromium, about 1.5% to less than 2% tungsten, about 0.1% to about 0.5% vanadium, about 0.2% to about 1.5% manganese, and about 0.05% to 0.25% carbon with the balance iron, wherein the percentages are by total weight of the composition, wherein the alloy is heated to an austenitizing temperature and then cooled to produce an austenite transformation product.

In accordance with another aspect of the present invention, a high-strength, high-toughness wrought steel composition includes about 2.5% to about 4% chromium, about 1.5% to about 3.5% tungsten, greater than 0.3% to about 0.5% vanadium, about 0.2% to about 1.5% manganese, and about 0.05% to 0.25% carbon with the balance iron, wherein the percentages are by total weight of the composition, wherein said alloy is heated to an austenitizing temperature and then cooled to produce an austenite transformation product.

In accordance with a further aspect of the present invention, a method of producing a high-strength, high-toughness wrought steel composition includes the steps of: forming a body of a ferritic steel composition comprising about 2.5% to about 4% chromium, about 1.5% to less than 2% tungsten, about 0.1% to about 0.5% vanadium, about 0.2% to about 1.5% manganese, and about 0.05% to 0.25% carbon with the balance iron, wherein the percentages are by total weight of the composition; heating the composition to an austenitizing temperature for a predetermined length of time; and cooling the composition from the austenitizing temperature at a rate to form an austenite transformation microstructure.

In accordance with a further aspect of the present invention, a method of producing a high-strength high-toughness wrought steel composition includes the steps of: fanning a body of a ferritic steel composition comprising about 2.5% to about 4% chromium, about 1.5% to about 3.5% tungsten, greater than 0.3% to about 0.5% vanadium, about 0.2% to about 1.5% manganese, and about 0.05% to 0.25% carbon with the balance iron, wherein the percentages are by total weight of the composition; heating the composition to an austenitizing temperature for a predetermined length of time; and cooling the composition from the austenitizing temperature at a rate to form an austenite transformation microstructure.

In accordance with a further aspect of the present invention, a method of producing a high-strength, high-toughness wrought steel composition includes the steps of: forming a body of a ferritic steel composition comprising 2.5% to 4.0% chromium, 1.5% to less than 2% tungsten, 0.0% to 1.5% molybdenum, 0.10% to 0.5% vanadium, 0.2% to 1.0% silicon, 0.2% to 1.5% manganese, 0.0% to 2.0% nickel, 0.0% to 0.25% tantalum, 0.05% to 0.25% carbon, 0.0% to 0.01% boron, 0.0% to 0.2% tita 0.05% to 0.25% Nb, 0.0 to 0.08% nitrogen, 0.0% to 0.2% Hf, 0.0% to 0.2% Zr, and 0.0 to 0.25% Cu, with the balance iron, wherein the percentages are by total weight of the composition; beating the composition to an austenitizing temperature for a predetermined length of time; cooling the composition at a rate to form a carbide-free acicular bainite microstructure; and tempering the composition at a temperature of not more than about 780° C. for a time of up to 1 hour per inch of thickness of the composition.

In accordance with a further aspect of the present invention, a method of producing a high-strength, high-toughness ferritic wrought steel composition includes the steps of: forming a body of a ferritic steel composition comprising 2.5% to 4.0% chromium, 1.5% to 3.5% tungsten, 0.0% to 1.5% molybdenum, greater than 0.3% to 0.5% vanadium, 0.2% to 1.0% silicon, 0.2% to 1.5% manganese. 0.0% to 2.0% nickel, 0.0% to 0.25% tantalum, 0.05% to 0.25% carbon, 0.0% to 0.01% boron, 0.0% to titanium, 0.05% to 0.25% Nb, 0.0 to 0.08% nitrogen, 0.0% to 0.2% Hf, 0.0% to 0.2% Zr, and 0.0% to 0.2% Cu, with the balance iron, wherein the percentages are by total weight of the composition; heating the composition to an austenitizing temperature for a predetermined length of time; cooling she composition at a rate to form a carbide-free acicular bainite microstructure; and tempering the composition at a temperature of not more than about 780° C. for a time of up to 1 hour per inch of thickness of the composition.

For a better understanding of the present invention, together with other and further objects, advantages and capabilities thereof, reference is made to the following disclosure and appended claims in connection with the above-described drawings.

DETAILED DESCRIPTION OF THE INVENTION

The first series of studies on composition effects were conducted on small (500-g) experimental heats of steel. The steels were cast as ≈1-in×0.5-in×5-in ingots that were subsequently rolled to 0.25-in. plate and 0.030-in. sheet, from which ⅓-size Charpy specimens and sheet tensile specimens were machined, respectively. The steels were given designations that provide nominal composition for the major elements Cr, W, and Mo.

Unless otherwise stated, the other elements in the steels were fixed at the following nominal compositions: V at 0.25%, C at 0.1%, Ta at 0.07–0.1%, Mn at 0.40–0.50%, Si at 0.1–0.2%, P at ≈0.015%, and S at 0.008% (all compositions in wt. %). The designation of 3Cr-3WVTa then specifies as steel with nominal composition of Fe-3% Cr-3% W-0.25% V-0.1% Ta-0.45% Mn-0.15% Si-0.1% C with a small amount of impurities (P, S, etc.).

Figure 1B:
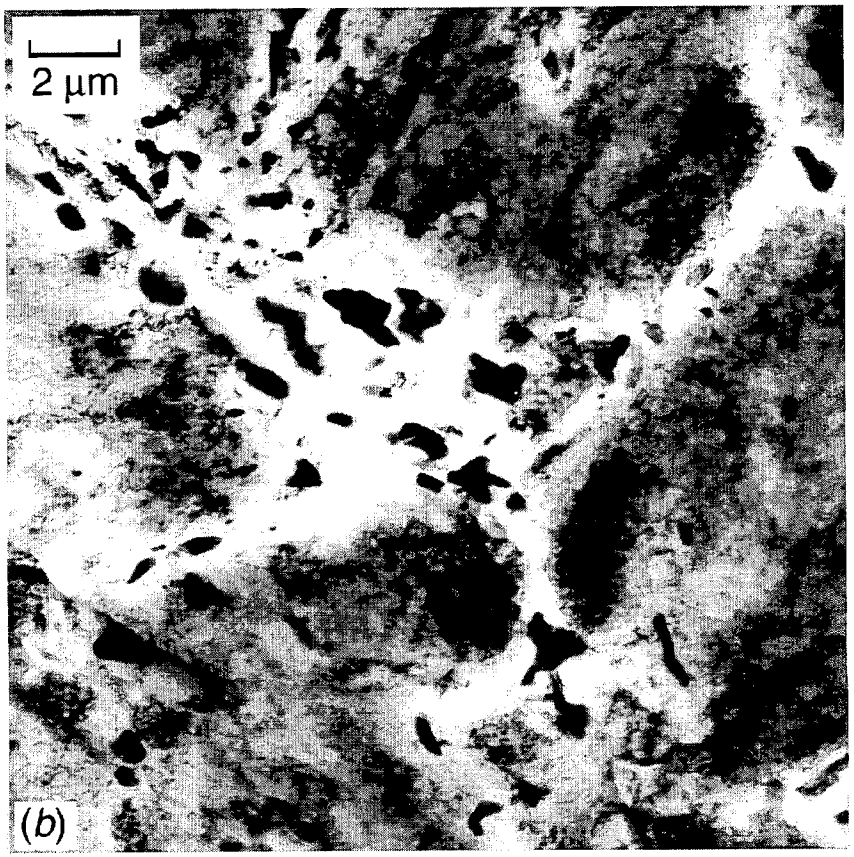
FIG. 1*b* is a photomicrograph of tempered structures of granular bainite in 2¼Cr-2WV steel.
Figure 1A:
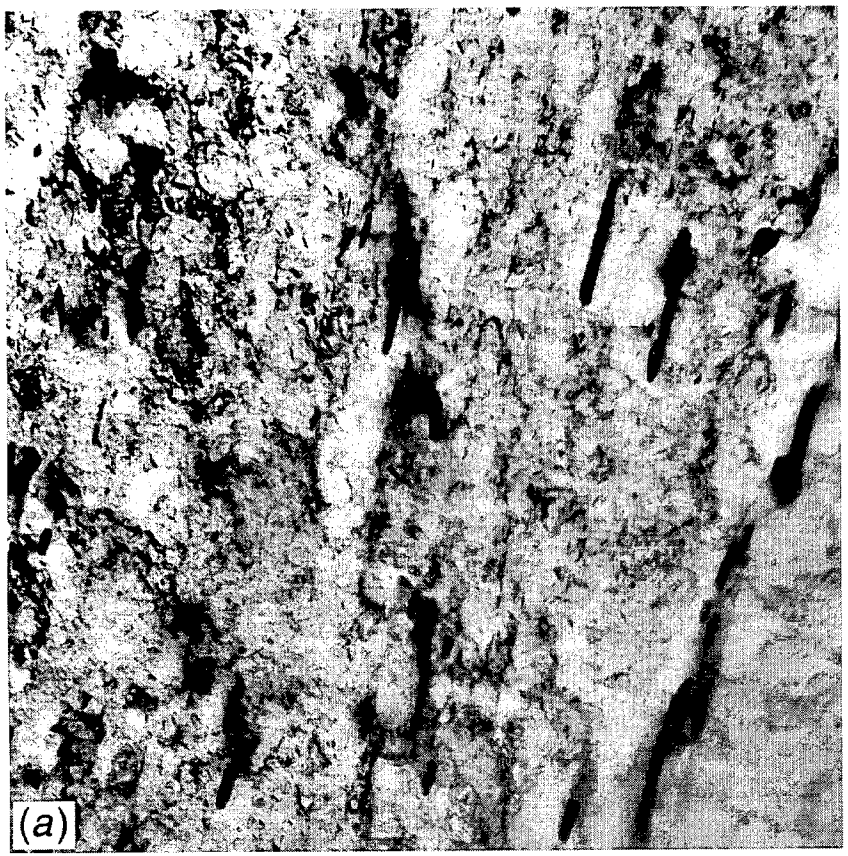
FIG. 1*a* is a photomicrograph of tempered structures of carbon-free acicular bainite in 2¼Cr-2WV steel.
Figure 2B:
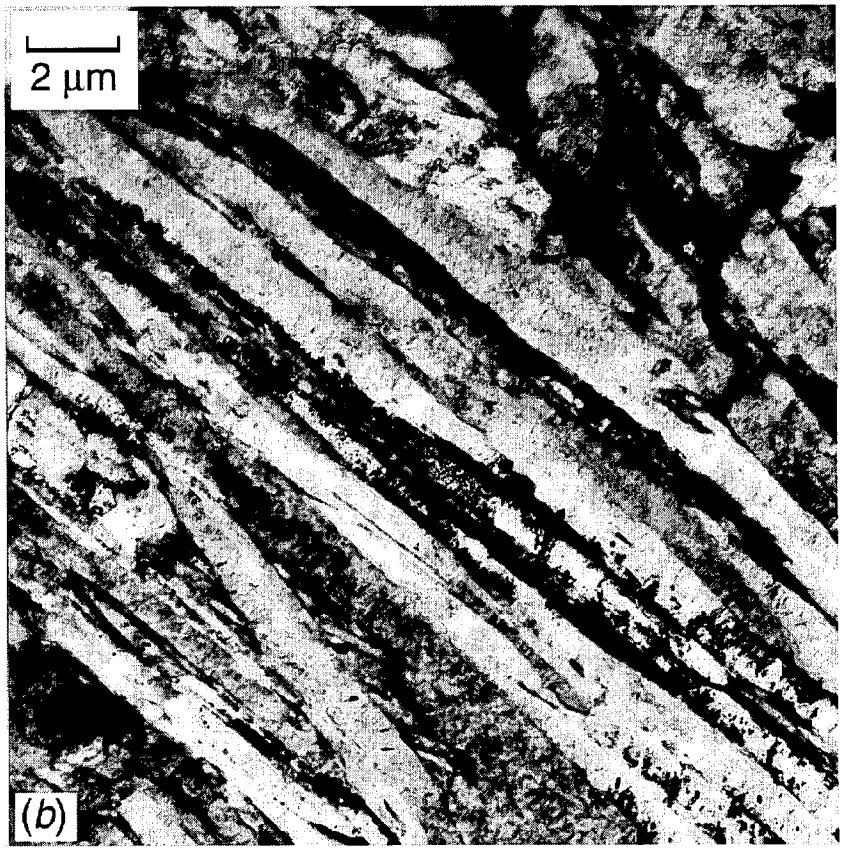
FIG. 2*b* is a photomicrograph of the 2¼Cr-2WV steel after a fast cool from the austenitization temperature.
Figure 2A:
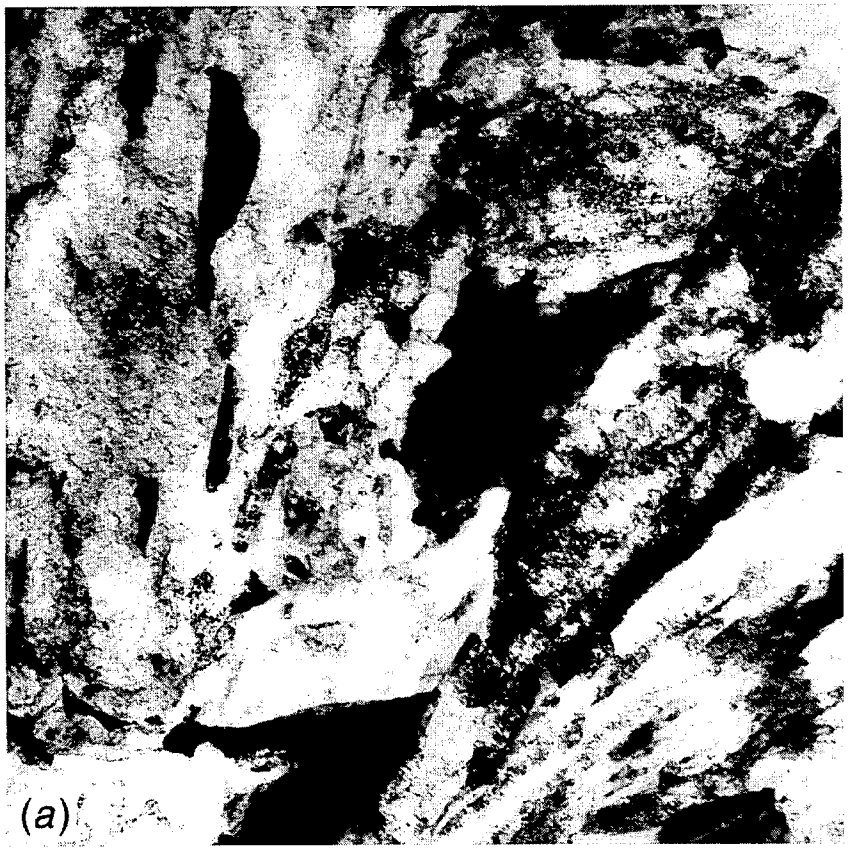
FIG. 2*a* is a photomicrograph of the 2¼Cr-2WV steel after a slow cool from the austenitization temperature.
Figure 3:
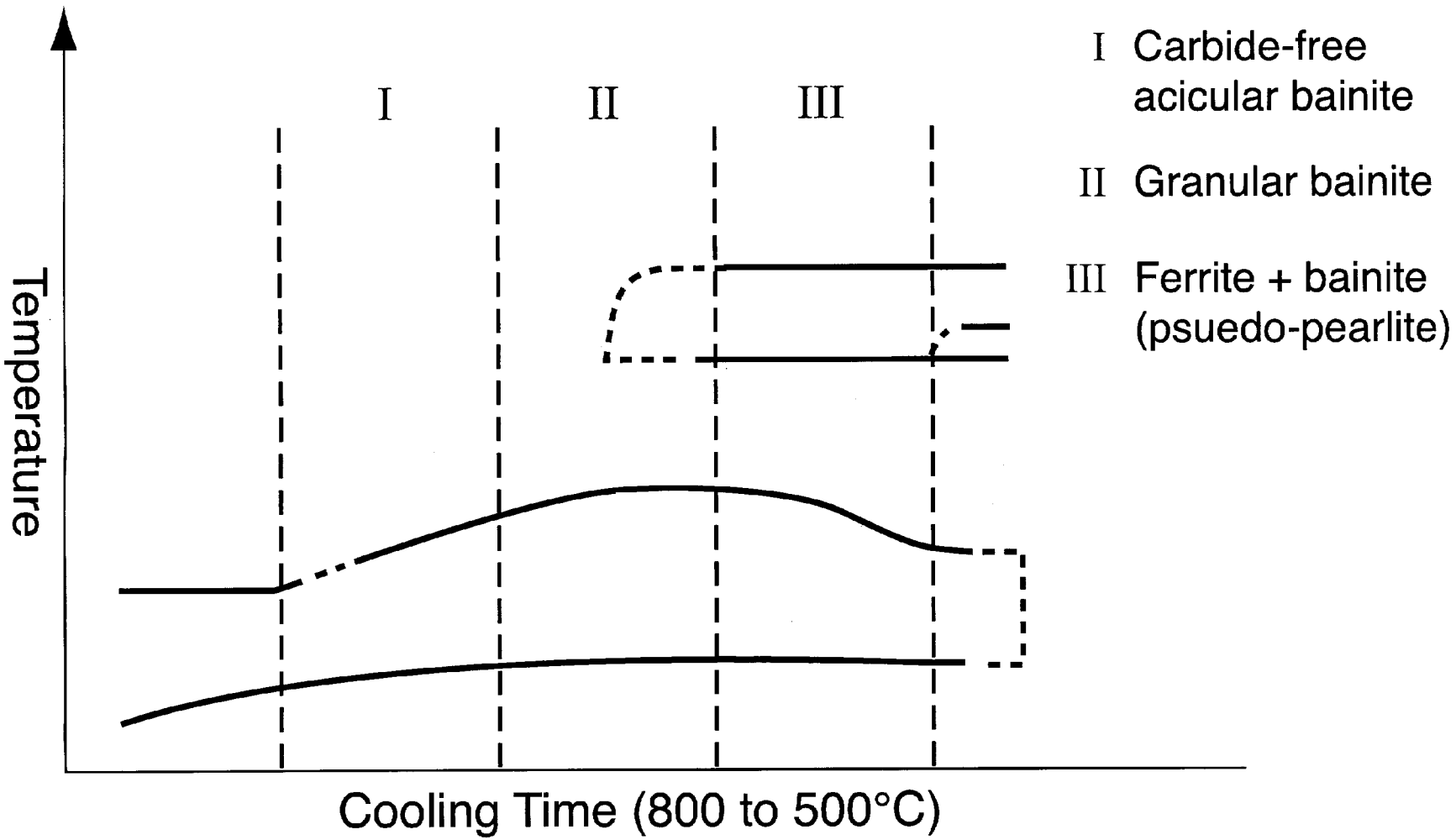
FIG. 3 is a schematic representation of a continuous-cooling transformation (CCT) diagram.

FIG. 3 shows a schematic representation of a continuous-cooling transformation (CCT) diagram. If a steel is cooled at a rate that passes through Zone I, acicular bainite forms; if it passes through Zone II (and avoids the ferrite transformation regime), granular bainite forms; if it passes through Zone 3, soft ferrite forms.

Figure 4B:
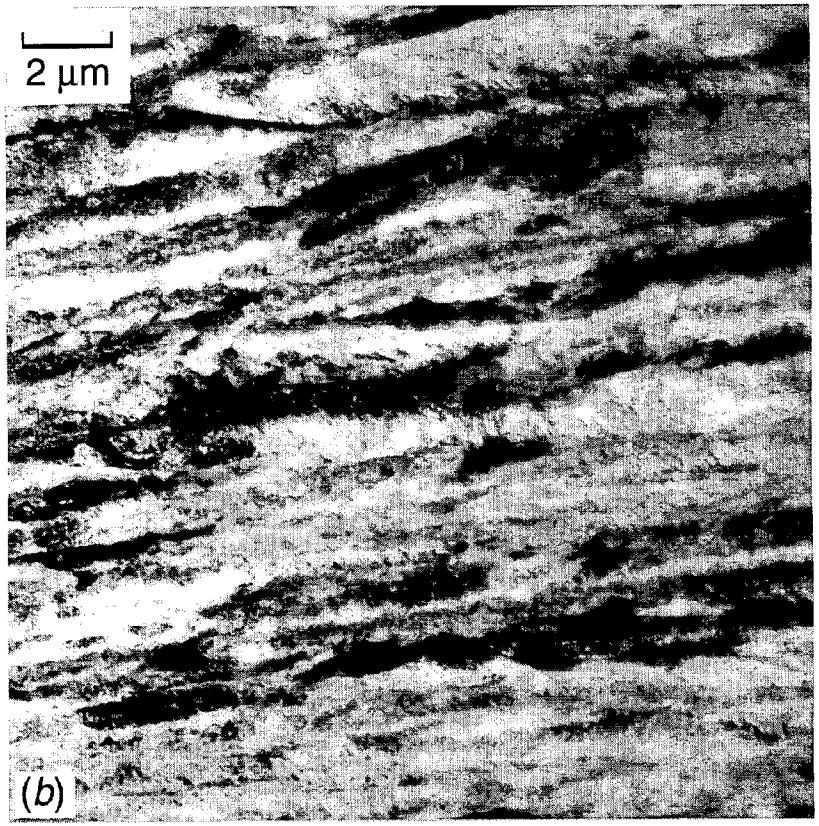
FIG. 4*b* is a photomicrograph of normalized 3Cr-3WV steel with the desired acicular bainite achieved by increasing hardenability over that of the 2¼Cr-2WV.
Figure 4A:
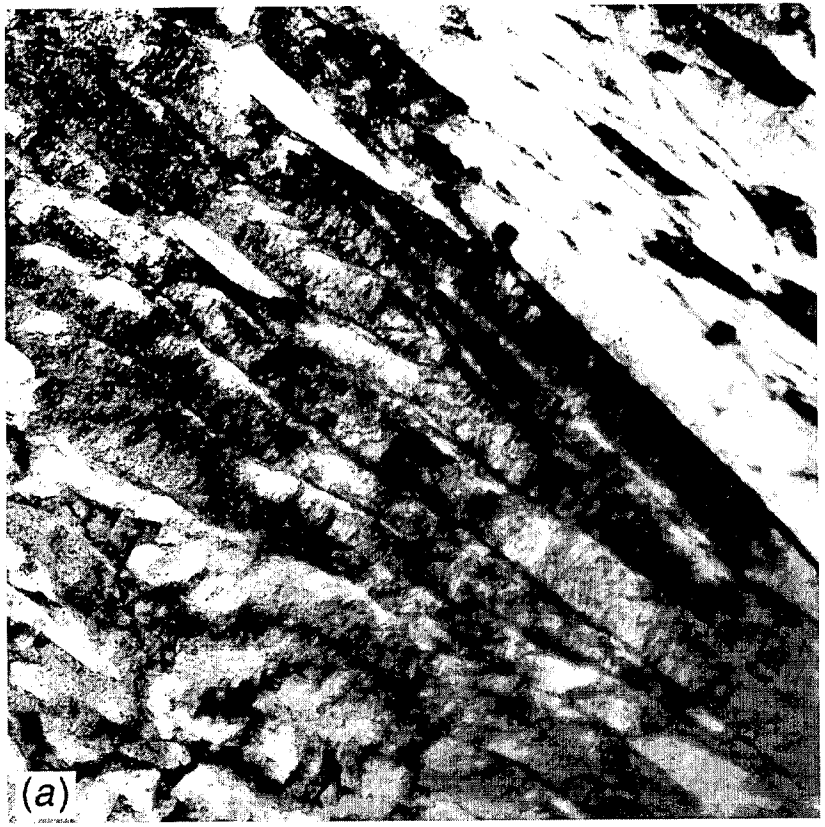
FIG. 4*a* is a photomicrograph of normalized 3Cr-2WV steel with the desired acicular bainite achieved by increasing hardenability over that of the 2¼Cr-2WV.

FIG. 4 shows the microstructure of normalized (a) 3Cr-2WV and (b) 3Cr-3WV steels with the desired acicular bainite achieved by increasing hardenability over that of the 2¼Cr-2WV. This microstructure was obtained under the same conditions that produced granular bainite in 2¼Cr-2WV.

Figure 5:
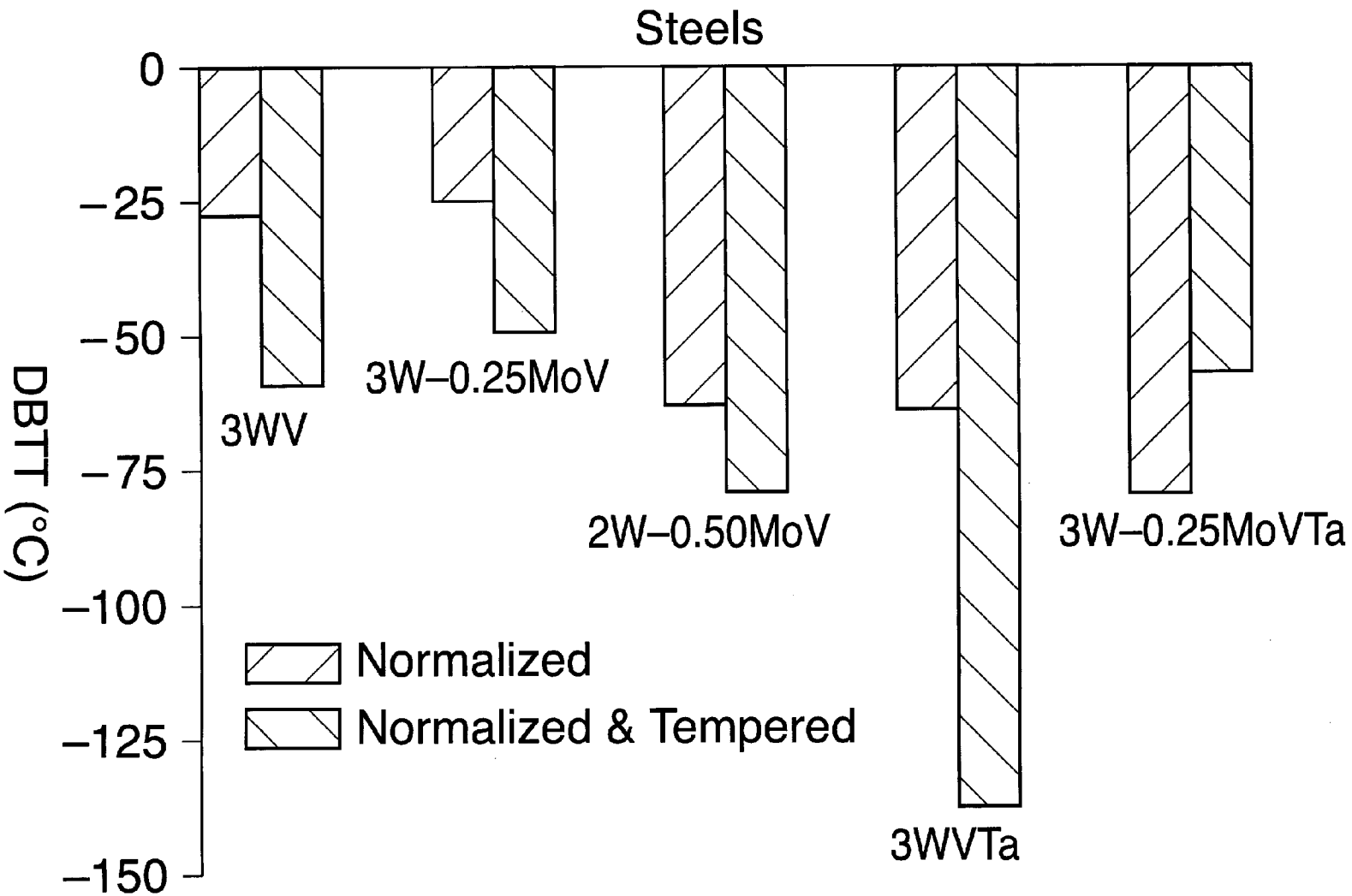
FIG. 5 is a graph showing effects of varying the molybdenum composition on the DBTT of various steels.

The molybdenum and tungsten ranges were revised based partially on the tensile and Charpy data in Tables 1 and 2, respectively. The tensile data shown in Table 1 indicate that increasing molybdenum in the 3Cr-3WV steel from 0 to 0.25% and 0.5% in the presence of 3% and 2% W, respectively, causes an increase in the strength. A similar change occurs when 0.25% Mo is added to the 3Cr-3WVTa steel. The results for the DBTT are shown in FIG. 5.

TABLE 1

Yield Stress Data Showing the Effect of Molybdenum

| | Yield Stress (Mpa) | | | |
|---|---|---|---|---|
| | Tempered at 700° C. | | Tempered at 750° C. | |
| Alloy Designation* | RT | 600° C. | RT | 600° C. |
| 3Cr—3WV | 797 | 614 | 577 | 443 |
| 3Cr—3W—0.25MoV | 821 | 567 | 595 | 474 |
| 3Cr—2W—0.5MoV | 826 | 592 | 592 | 431 |
| 3Cr—3WVTa | 835 | 609 | 728 | 546 |
| 3Cr—3W—0.25MoVTa | 935 | 641 | 675 | 403 |
| 3Cr—2W—0.75MoVTa | 991 | ND** | ND | ND |

*Compositions are in wt %; composition or other elements (wt. %): V = 0.25, Ta = 0.1, Mn = 0.4–0.5, Si = 0.1–0.2, C = 0.1

**ND = no data

TABLE 2

Charpy Impact Data Showing the Effect of Molybdenum

| | Tempered at 700° C. | | Tempered at 750° C. | | Untempered | |
|---|---|---|---|---|---|---|
| Alloy Designation* | DBTT (° C.) | USE (J) | DBTT (° C.) | USE (J) | DBTT (° C.) | USE (J) |
| 3Cr—3WV | −59 | 10.0 | −96 | 13.8 | −28 | 8.1 |
| 3Cr—3W—0.25MoV | −50 | 10.6 | −113 | 11.8 | −25 | 8.9 |
| 3Cr—2W—0.5MoV | −80 | 11.0 | −123 | 11.2 | −63 | 8.0 |
| 3Cr—3WVTa | −138 | 12.3 | −98 | 12.4 | −64 | 11.0 |
| 3Cr—3W—0.25MoVTa | −57 | 9.2 | −84 | 10.2 | −80 | 6.4 |

*Compositions are in wt %; composition or other elements (wt. %): V = 0.25, Ta = 0.1, Mn = 0.4–0.5, Si = 0.1–0.2, C = 0.1

FIG. 5 shows the effect of varying the molybdenum composition on the DBTT of 3Cr-3WV and 3Cr-3WVTa steels.

These improvements in strength are accompanied by improvements in the DBTT and USE in the Charpy tests shown in Table 2 for both the 3Cr-3WV and 3Cr-3WVTa steels. (Note that all of the Charpy data in these and many of the following tables are for miniature ⅓-size Charpy specimens, and this is the reason for the small USE relative to that of a standard Charpy specimen.) The improvement occurs in both the normalized and the normalized-and-tempered conditions. The partial replacement of tungsten by molybdenum appears to have more effect than just adding molybdenum to the 3% W steel.

What is especially important in the Charpy data is the decrease in the ductile-brittle transition temperature in the untempered condition, since it is the elimination of the time-consuming and expensive tempering treatment that makes the new steels most attractive to replace commercial steels in use presently. Tensile tests of a 3Cr-2W-0.75MoVTa steel indicated a still higher room temperature yield stress, although at 600° C., there was no improvement.

These results indicate that molybdenum in combination with tungsten can improve the properties of the 3Cr—WVTa steels over the use of tungsten by itself. However, it is necessary to limit the total amount of the two elements, since these elements promote the formation of the undesirable Laves phase—$Fe_2Mo$, $Fe_2W$, or $Fe_2(MoW)$. To minimize Laves phase, the Mo and W will be limited as follows: $2[Mo]+[W] \leqq 3.5$, where [Mo] and [W] are compositional concentrations in wt. %.

Tables 3 and 4 compare the properties of a steel with 3% Cr, 3% W, and 0.4% V (a higher vanadium concentration than established in the original patent) with the basic steel proposed in the previous patent, which contains 3% Cr, 3% W, and 0.25% V (3Cr-3WV).

TABLE 3

Effect of Vanadium on Charpy Impact Properties

| | Tempered at 700° C. | | Tempered at 750° C. | | Untempered | |
|---|---|---|---|---|---|---|
| Alloy Designation* | DBTT (° C.) | USE (J) | DBTT (° C.) | USE (J) | DBTT (° C.) | USE (J) |
| 3Cr—3W—0.25V | −59 | 10.0 | −96 | 13.8 | −28 | 8.1 |
| 3Cr—3W—0.4V | −129 | 11.0 | −96 | 11.1 | −82 | 10.3 |

*Compositions are in wt %; composition or other elements (wt. %): V = 0.25, Mn = 0.4–0.5, Si = 0.1–0.2, C = 0.1

TABLE 4

Effect of Vanadium on Yield Stress

| | Yield Stress (Mpa) | | | |
|---|---|---|---|---|
| | Tempered at 700° C. | | Tempered at 750° C. | |
| Alloy Designation* | RT | 600° C. | RT | 600° C. |
| 3Cr—3W—0.25V | 722 | 527 | 552 | 413 |
| 3Cr—3W—0.4V | 781 | 540 | 565 | 403 |

*Compositions are in wt %; composition or other elements (wt. %): V = 0.25, Mn = 0.4–0.5, Si = 0.1–0.2, C = 0.1

Data in Table 3 show that increasing vanadium in the 3Cr-3WV steel from 0.25 to 0.4 wt % decreases the DBTT in the untempered condition by the same amount that is produced by tempering the steel at 750° C.—the highest tempering temperature used and the heat treatment expected to produced the best toughness. In addition to improving the DBTT, the increase in vanadium also improves the yield strength at both room temperature and 600° C., as shown in Table 4.

Comparison of data in Tables 2 and 3 indicates that improvements in DBTT with an increase in vanadium from 0.25 to 0.4% are even greater than obtained with 2% W and 0.5% Mo. These results suggest that there is more than one option to obtain a superior toughness/strength combination in the Fe-3Cr-3W—V steels, especially for the steel to be used without a tempering treatment.

One reason for widening the carbon concentration range is that the original work concentrated on the 0.1 wt % C steel (a typical composition for these types of steel), and therefore, the range should have been wider to allow a specification of a range of compositions for the steel processors. Since then, more work on the steels produced another reason for the range change as illustrated by the data in Table 5.

TABLE 5

Effect of tantalum on the Charpy Impact Properties

| | Tempered at 700° C. | | Tempered at 750° C. | | Untempered | |
|---|---|---|---|---|---|---|
| Alloy Designation* | DBTT (° C.) | USE (J) | DBTT (° C.) | USE (J) | DBTT (° C.) | USE (J) |
| 3Cr—3WV | −59 | 10.0 | −96 | 13.8 | −28 | 8.2 |
| 3Cr—3WV—0.09Ta—0.08C | −138 | 12.3 | −98 | 12.4 | −64 | 11.0 |
| 3Cr—3WV—0.05Ta—0.09C | −66 | 9.4 | −103 | 11.8 | ND | |
| 3Cr—3WV—0.17Ta—0.09C | −115 | 14.2 | −91 | 13.2 | −72 | 12.4 |

*Compositions are in wt %; composition or other elements (wt. %): V = 0.25, Mn = 0.4–0.5, Si = 0.1–0.2, C = 0.1

This table shows Charpy data for three steels with different tantalum concentrations (0.05, 0.09 and 0.17 wt %) and the data for the base steel. All of the tantalum-modified steels are improvements over the base composition. Further, for the steels with 0.05 and 0.09% Ta, the properties of the steel with the lowest carbon concentration and the highest tantalum had superior properties compared to that with lower tantalum and higher carbon. This implies that the tantalum and carbon compositions can be manipulated to optimize the properties. This optimization could result in a steel with a carbon concentration lower than the 0.1 wt % level, a desirable result, because lower carbon means improved weldability. The yield stresses of the steels with 0.05 and 0.09% Ta were comparable after the 700° C. temper, but the steel with the 0.09% Ta had the best strength after the 750° C. anneal. Table 5 also indicates that a higher Ta level leads to increased toughness. However, the steel with 0.17% Ta had lower strength than the other two steels, implying that a balance needs to be achieved between the Ta and C, which will be discussed below.

Nickel is known to improve the toughness of ferritic steels, and this was shown to be the case for the 3Cr-3WV steel, as shown in Table 6. Therefore, nickel is being added to the composition specifications for this effect. Manganese has a similar effect. Since nickel is not to be used for reduced-activation steels, for which the steels were originally developed (see previous patent), the manganese range has been expanded for this purpose.

TABLE 6

Effect of Nickel on the Charpy Properties

| | Tempered at 700° C. | | Tempered at 750° C. | | Untempered | |
|---|---|---|---|---|---|---|
| Alloy Designation* | DBTT (° C.) | USE (J) | DBTT (° C.) | USE (J) | DBTT (° C.) | USE (J) |
| 3Cr—3WV | −59 | 10.0 | −96 | 13.8 | −28 | 8.2 |
| 3Cr—3WV—2Ni | −125 | 10.0 | −148 | 11.2 | ND | |

*Compositions are in wt %; composition or other elements (wt. %): V = 0.25, Mn = 0.4–0.5, Si = 0.1–0.2, C = 0.1

The new 3Cr steels are intended for elevated-temperature applications. Therefore, creep properties are important. Creep studies were made on the base compositions discussed above, 3Cr-3WV and 3Cr-3WVTa, on specimens taken from larger heats than those from which the above tests (1 lb) were taken. The heats were about 370 lb (168 kg) made by a vacuum-induction melting/vacuum-arc re-melt (VIM/VAR) process. Chemical compositions are given in Table 7.

TABLE 7

Chemical Composition of 370-lb VIM/VAR Heats of Steel (wt. %)

| Steel | C | Mn | P | S | Si | Cr | V | W | N | Ta |
|---|---|---|---|---|---|---|---|---|---|---|
| 3Cr—3WV | 0.10 | 0.39 | 0.010 | 0.004 | 0.16 | 3.04 | 0.21 | 3.05 | 0.004 | <0.01 |
| 3Cr—3WVTa | 0.10 | 0.41 | 0.011 | 0.005 | 0.16 | 3.02 | 0.21 | 3.07 | 0.003 | 0.09 |

Ni <0.1, Mo = 0.01, Nb = 0.003–0.004; Ti = 0.001, Co = 0.005–0.006, Cu = 0.01, Al = 0.003, B = 0.001, As = 0.001, Sn = 0.003–0.004, O = 0.004–0.005

The VIM/VAR heats were forged to bars ≈2×5×60 inches. To obtain the test specimens, the steels were hot rolled to 0.625-in plate. The plates were normalized by austenitizing 1 h at 1100° C., followed by an air cool. Some specimens were tested in the normalized condition, and other were in the normalized-and-tempered condition, where tempering of the plates was for 1 h at 700° C.

Figure 6:
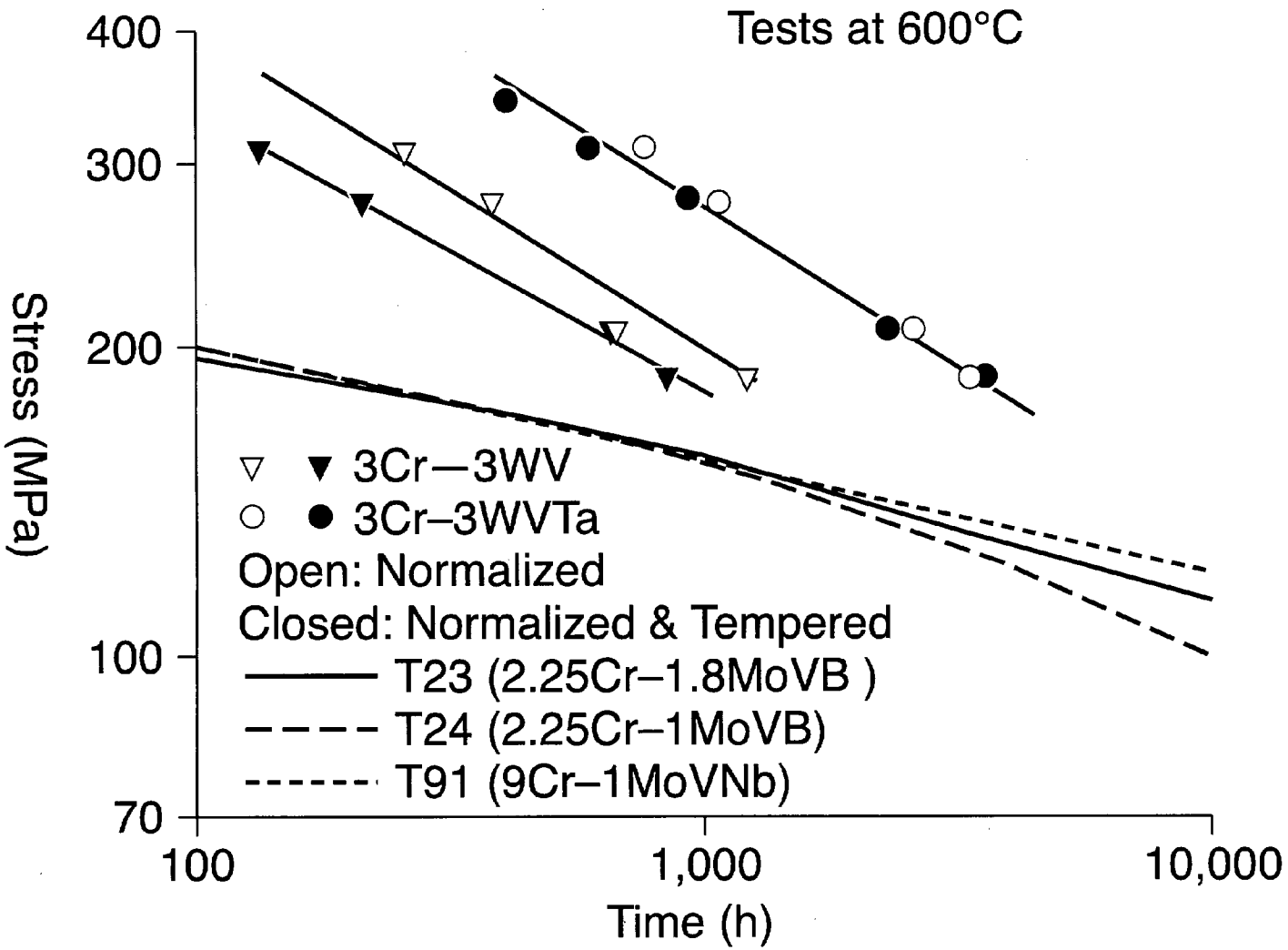
FIG. 6 is a graph of creep-rupture properties of the 3Cr-3WV and 3Cr-3WVTa steels at 600° C. in the normalized and normalized-and-tempered conditions compared to three commercial steels.
Figure 7:
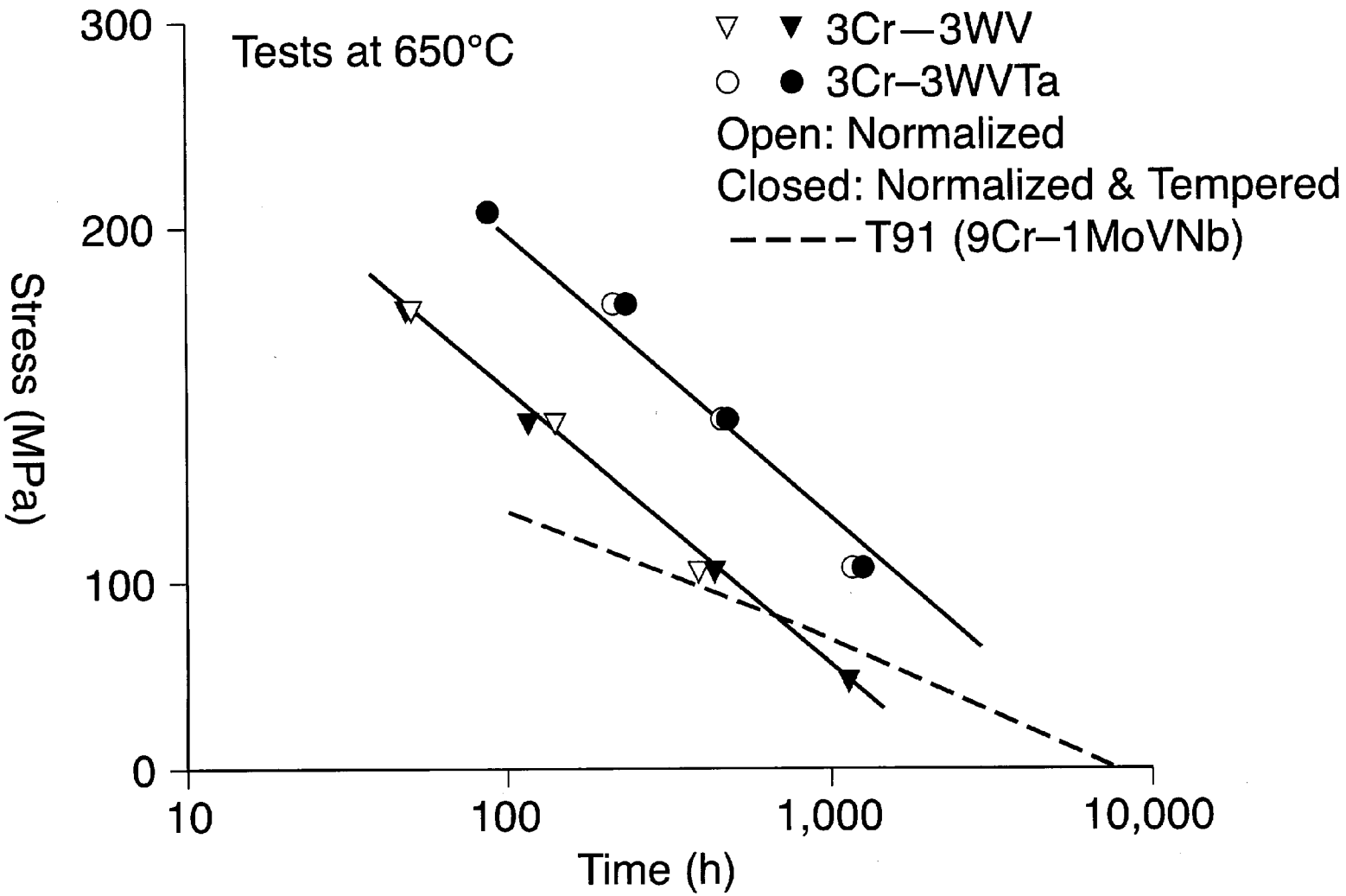
FIG. 7 is a graph of creep-rupture properties of the 3Cr-3WV and 3Cr-3WVTa steels at 650° C. in the normalized and normalized-and-tempered conditions compared to a commercial steel.

Creep-rupture studies of the 3Cr-3WV and 3Cr-3WVTa steels were made at 600° C., as shown in FIG. 6 and 650° C., as shown in FIG. 7. At both temperatures, the results demonstrate the effect of tantalum on improving the creep-rupture properties. The rupture lives of the 3Cr-3WVTa were 2–3 times longer than those for the 3Cr-3WV steel at both 600 and 650° C. For the 3Cr-3WV steel, there was a difference in the properties of the steel in the normalized and the normalized-and-tempered conditions. There was essentially no difference between the two different heat-treated conditions for the 3Cr-3WVTa.

The 3Cr-3WVTa steel had properties that were better than those of some of the commercial steels used for the applications for which the new 3Cr steels are designed. These are T23, a nominal Fe-2.25Cr-1.5W-0.2Mo-0.25V-0.005B-0.07C steel, T24, a nominal Fe-2.4Cr-1Mo-0.25V-0.005B-0.07C steel, and T91, a nominal Fe-9Cr-1Mo-0.2V-0.06Nb-0.06N-0.07C steel. For all three, the superiority at 600° C. of the 3Cr-3WVTa is obvious. Referring to FIG. 7, at 650° C., data for comparison were only available for the T91, and again the 3Cr-3WVTa steel has better properties than those of the T91 at this temperature.

The creep-rupture tests described hereinabove demonstrate that the base 3Cr-3WV and 3Cr-3WVTa steels have superior properties compared to the commercial steels T23, T24, and T91. The 0.09% Ta addition to the 3Cr-3WV composition has the effect of increasing the creep-rupture strength by 2–3 times. Furthermore, the 3Cr-3WV and 3Cr-3WVTa can be used without tempering and still get improved creep strength over the commercial steels, which are typically used in a tempered condition.

FIG. 6 shows creep-rupture properties of the 3Cr-3WV and 3Cr-3WVTa steels at 600° C. in the normalized and normalized-and-tempered conditions compared to three commercial steels. FIG. 7 shows creep-rupture properties of the 3Cr-3WV and 3Cr-3WVTa steels at 650° C. in the normalized and normalized-and-tempered conditions compared to a commercial steel.

The first tests on specimens from 1-lb (500-g) heats described hereinabove indicated that steels with excellent tensile and impact properties can be obtained if the steels have a base of 3Cr-3W-0.25V-0.1C (3Cr-3WV) and 3Cr-3W-0.25V-0.10Ta-0.1C (3Cr-3WVTa) and contain about 0.2Si and 0.5Mn. Creep-rupture studies on specimens from 370-lb heats, described herein, were then made on the base compositions. To further delineate the optimum chemical composition of the steels, these base compositions were used as the starting point to examine varying chemical compositions to determine the optimum composition range for the various elements to be included in the prospective steels.

The approximately 1-lb vacuum-arc heats and about 20-lb (9-kg) air-induction melted heats (AIM) and vacuum-induction melted (VIM) heats were prepared. The small ingots (1 in×1 in×4 in) were hot rolled at 1150° C. to 0.5-in thickness. The large heats (2.5 in×2.5 in×8 in) were forged 25% at 1150° C. and then hot rolled at 1150° C. to 0.5-in thickness. The rolled plates were normalized (either 1100° C./1 h/AC or 1150° C./1h/AC) and tempered (700° C./1 h/AC). For selected alloys, specimens were machined from the small heats for metallography, Rockwell and hot hardness (room temperature to 700° C.) tests, two tensile tests (one at room temperature and one at 650° C.), and room temperature and −40° C. Charpy tests (with a miniature specimen). Similar specimens were obtained from the large heats (full-size Charpy specimens were obtained, in this case), and in addition, four creep specimens were obtained.

Compositions of the steels with the 3Cr-3WV (V alloys) as the base composition are given in Table 8, and those with the 3Cr-3WVTa base (VT alloys) are given in Table 9. The V alloy, shown in Table 8, and the VT alloy, shown in Table 9 are the respective base compositions.

TABLE 8

3Cr—3WV Steels With Varying Chemical Compositions (wt %)[a]

| Steel | C | Mn | Si | Cr | V | W | Mo | Ta | Nb | N | B |
|---|---|---|---|---|---|---|---|---|---|---|---|
| V[b] | 0.10 | 0.40 | 0.16 | 3.00 | 0.21 | 3.00 | | | | | |
| V1[b] | 0.10 | 1.00 | 1.00 | 3.00 | 0.21 | 3.00 | | | 0.05 | | |
| V2[b] | 0.10 | 0.50 | 0.50 | 3.00 | 0.21 | 3.00 | | | 0.05 | | |
| V3[b] | 0.10 | 1.00 | 1.00 | 3.00 | 0.21 | 3.00 | 1.00 | | 0.05 | | |
| V4[b] | 0.10 | 0.50 | 0.50 | 3.00 | 0.21 | 3.00 | 1.00 | | 0.05 | | |
| V5[b] | 0.10 | 1.00 | 1.00 | 3.00 | 0.21 | 3.00 | | 0.10 | 0.05 | | |
| V6[c] | 0.14 | 0.44 | 0.12 | 2.94 | 0.23 | 2.01 | 0.75 | | | 0.011 | 0.001 |
| V6A[d] | 0.07 | 0.57 | 0.23 | 3.01 | 0.24 | 2.02 | 0.75 | | | <0.001 | 0.001 |
| V6B[d] | 0.07 | 0.46 | 0.22 | 3.01 | 0.24 | 2.03 | 0.75 | | | <0.001 | <0.001 |
| V7[d] | 0.08 | 0.24 | 0.21 | 3.01 | 0.24 | 1.54 | 0.75 | | | <0.001 | 0.001 |
| V7A[d] | 0.14 | 0.47 | 0.21 | 3.00 | 0.24 | 1.52 | 0.75 | | | <0.001 | |
| V8[d] | 0.13 | 0.27 | 0.21 | 3.04 | 0.24 | 1.55 | 0.76 | | | <0.001 | 0.008 |
| V8A[d] | 0.11 | 0.52 | 0.21 | 3.04 | 0.24 | 1.54 | 0.75 | | | <0.001 | 0.007 |
| V9[d] | 0.14 | 0.33 | 0.22 | 3.02 | 0.24 | 2.97 | 0.01 | | | <0.001 | 0.001 |

[a]Balance of composition is iron;
[b]1-lb VIM heat;
[c]20-lb AIM heat;
[d]20-lb VIM heat.

TABLE 9

3Cr—3WVTa Steels With Varying Chemical Compositions (wt %)[a]

| Steel | C | Mn | Si | Cr | V | W | Mo | Ta | N | B | Hf | Zr | B |
|---|---|---|---|---|---|---|---|---|---|---|---|---|---|
| VT[b] | 0.08 | 0.39 | 0.15 | 2.96 | 0.19 | 2.98 | | 0.10 | 0.008 | | | | |
| VT1[b] | 0.09 | 0.94 | 1.05 | 2.96 | 0.19 | 3.03 | | 0.10 | 0.002 | | | | |
| VT2[b] | 0.09 | 0.39 | 0.16 | 2.97 | 0.20 | 3.04 | | 0.24 | 0.001 | | | | |
| VT3[b] | 0.10 | 0.40 | 0.16 | 3.00 | 0.21 | 3.00 | | 0.50 | | | | | |
| VT5[b] | 0.10 | 0.40 | 0.16 | 3.00 | 0.21 | 3.00 | | 2.00 | | | | | |
| VT6[b] | 0.10 | 0.40 | 0.16 | 3.00 | 0.21 | 3.00 | | 1.00 | | | | | |
| VT7[b] | 0.10 | 0.40 | 0.16 | 3.00 | 0.21 | 3.00 | | 3.00 | | | | | |
| VT8[b] | 0.12 | 0.50 | 0.20 | 3.00 | 0.25 | 3.00 | | 0.25 | | | | | |
| VT9[b] | 0.09 | 0.48 | 0.19 | 2.98 | 0.24 | 3.05 | | 0.13 | 0.02 | | | | |
| VT10[b] | 0.12 | 0.50 | 0.20 | 3.00 | 0.25 | 1.50 | 0.75 | 0.13 | | | | | |
| VT11[b] | 0.11 | 0.48 | 0.19 | 3.06 | 0.24 | 2.15 | 0.83 | 0.13 | | | | | |
| VT11A[c] | 0.12 | 0.39 | 0.15 | 2.99 | 0.23 | 2.06 | 0.75 | 0.036 | 0.01 | | | | |
| VT11B[c] | 0.12 | 0.41 | 0.18 | 2.97 | 0.24 | 2.05 | 0.75 | 0.10 | 0.005 | | | | |
| VT12[b] | 0.11 | 0.48 | 0.20 | 3.00 | 0.25 | 3.00 | | 0.13 | | | | | |
| VT12A[c] | 0.12 | 0.40 | 0.13 | 2.96 | 0.24 | 2.97 | 0.01 | 0.043 | 0.01 | | | | |
| VT12B[c] | 0.12 | 0.56 | 0.19 | 2.96 | 0.24 | 2.98 | 0.01 | 0.13 | 0.005 | | | | |
| VT13[c] | 0.11 | 0.43 | 0.13 | 2.95 | 0.23 | 2.01 | 0.74 | 0.04 | 0.013 | | | | 0.001 |

TABLE 9-continued

3Cr—3WVTa Steels With Varying Chemical Compositions (wt %)[a]

| Steel | C | Mn | Si | Cr | V | W | Mo | Ta | N | B | Hf | Zr | B |
|---|---|---|---|---|---|---|---|---|---|---|---|---|---|
| VT14[c] | 0.12 | 0.44 | 0.13 | 2.95 | 0.23 | 2.00 | 0.75 | 0.05 | 0.01 | | | | 0.005 |
| VT14A[d] | 0.07 | 0.51 | 0.21 | 2.98 | 0.24 | 2.01 | 0.75 | 0.07 | | | | | 0.01 |
| VT14B[d] | 0.07 | 0.51 | 0.21 | 2.98 | 0.24 | 2.01 | 0.75 | 0.07 | | | | | 0.008 |
| VH[b] | 0.12 | 0.50 | 0.20 | 3.00 | 0.25 | 2.99 | | | | | 0.13 | | |
| VZ[b] | 0.12 | 0.50 | 0.20 | 3.00 | 0.25 | 2.99 | | | | | | 0.07 | |
| VZA[b] | 0.12 | 0.50 | 0.20 | 3.00 | 0.25 | 3.00 | | | | | | 0.13 | |

[a]Balance of composition is iron;
[b]1-lb VIM heat;
[c]20-lb AIM heat;
[d]20-lb VIM heat.

Results for 1-lb Heats

Figure 8:
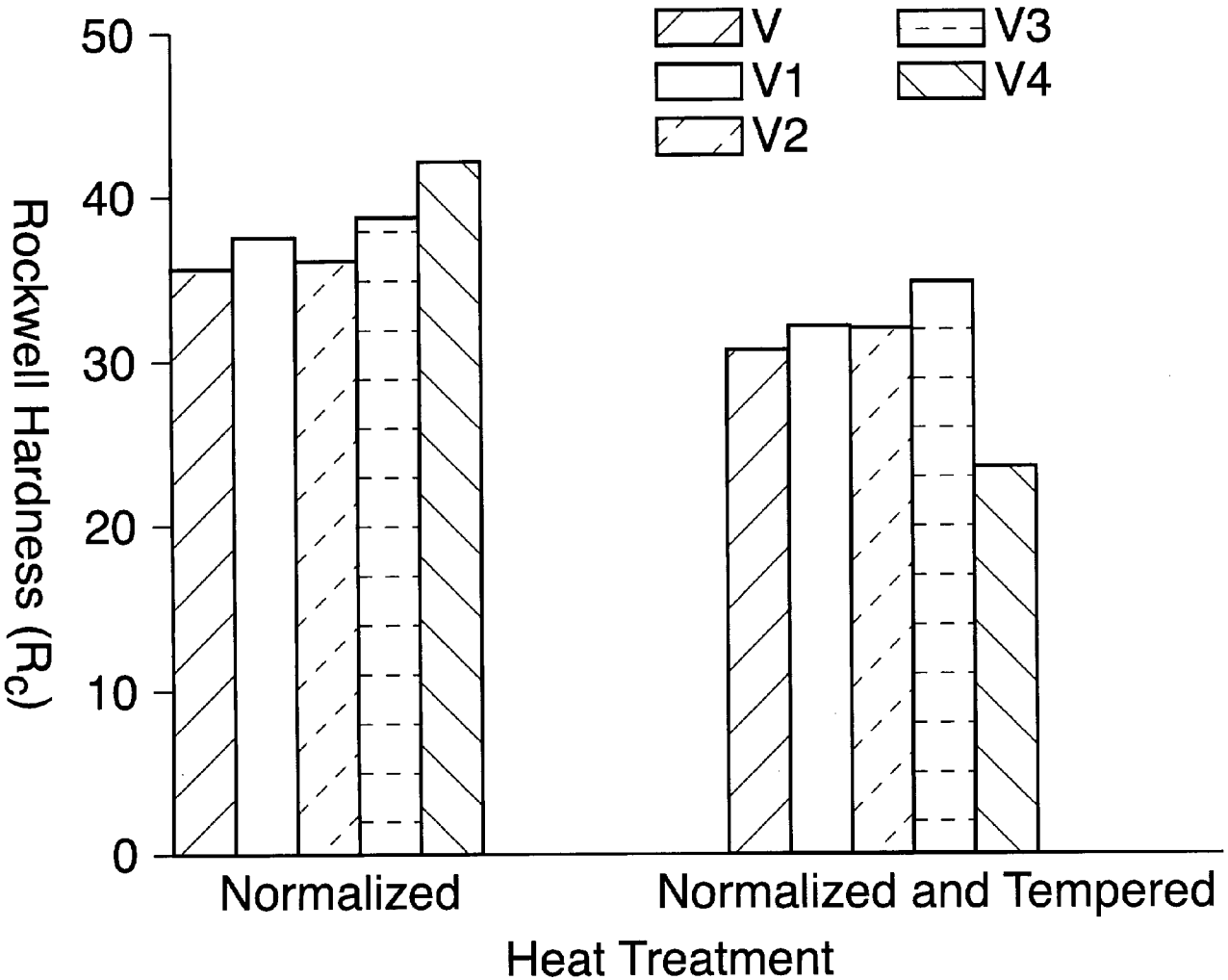
FIG. 8 is a graph of Rockwell hardness of 3Cr-3WV base (V alloys) with various compositional variations.
Figure 9A:
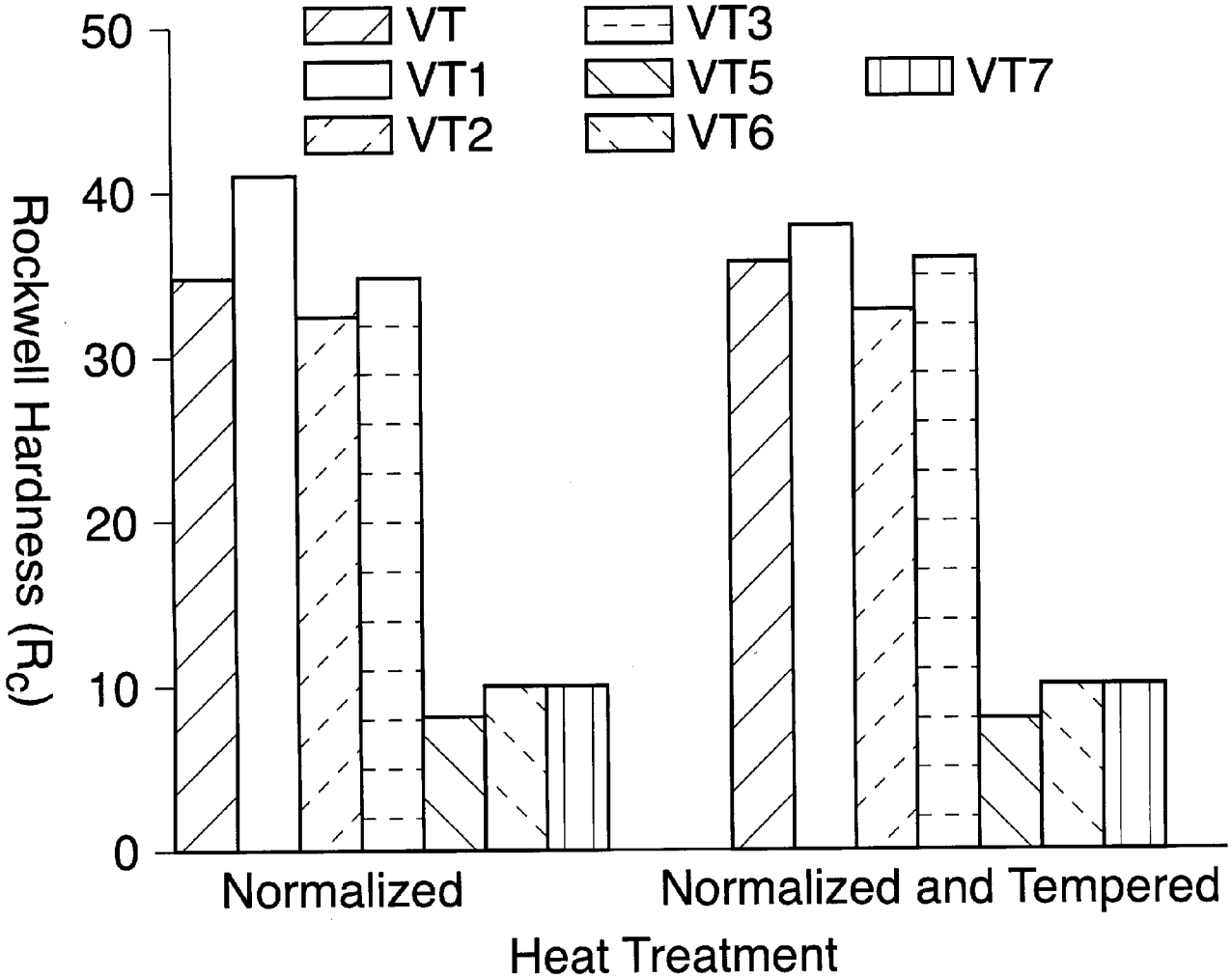
FIGS. 9*a* and 9*b* are graphs showing Rockwell hardness of 3Cr-3WVTa base (VT alloys) with compositional variations.
Figure 9B:
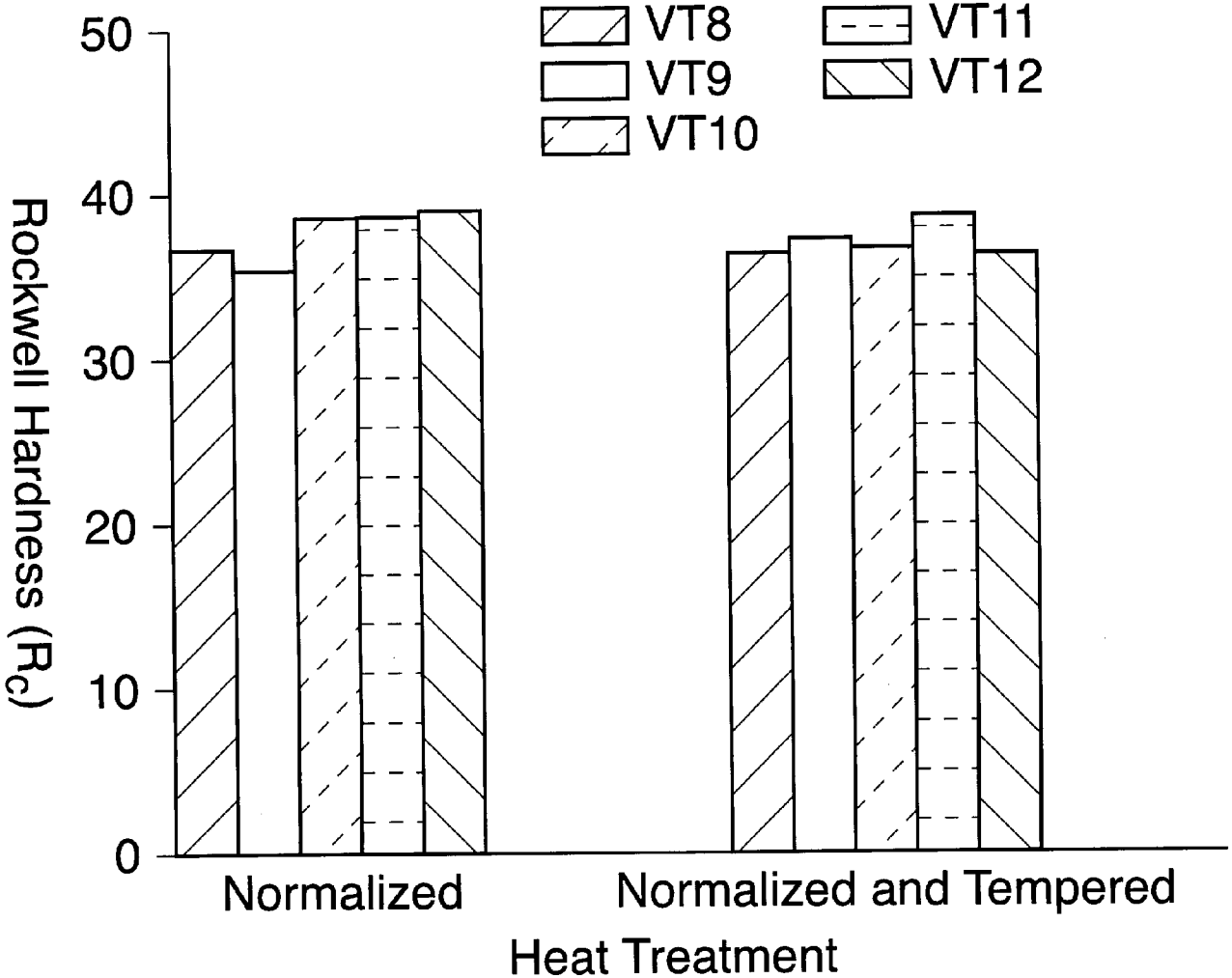

For the small heats of V, as shown in FIG. 8 and VT, as shown in FIG. 9, the relative strength of the steels was first assessed by hardness. The V1–V4 steels with higher Si and Mn along with Nb, shown in Table 8 all had higher hardness than the base 3Cr-3WV (V) in the normalized condition, and all but V4 were harder after tempering as shown in FIG. 8. Metallography indicated that V3 and V4 contained some ferrite, probably because of the higher composition of ferrite formers—silicon and molybdenum. The niobium could also have an effect, if niobium carbides did not all dissolve during austenitization, thus tying up the austenite former carbon and also reducing the hardenability when cooled, due to the reduced carbon in solution.

FIG. 8 shows Rockwell hardness of 3Cr-3WV base (V alloys) with various compositional variations, and FIG. 9 shows Rockwell hardness of 3Cr-3WVTa base (VT alloys) with compositional variations.

Such an effect on hardenability was observed as shown in FIG. 9 for tantalum for the 3Cr-3WVTa-base (VT) steels VT5 (2.0 Ta), VT6 (1.0 Ta), and VT7 (3.0 Ta). In this case, the TaC did not dissolve during austenitization, and the hardenability was lower due to the lack of carbon in solution. This resulted in low hardness for these steels. The steel with 0.5% Ta (VT3) did not show a similar deterioration in hardness.

Both the V and the VT steels showed an effect of the combination of 1% Mn and 1% Si.

The V1 (1% Mn, 1% Si) was harder than V and V2 (0.5% Mn, 0.5% Si), as shown in FIG. 8.

Likewise, the VT1 (1% Mn, 1% Si) was harder than the VT, as shown in FIG. 9. The hardness advantage was also observed for the tensile properties, shown in Table 10. Despite the increase in strength for V1 and VT1, there was also an increase in ductility for the stronger steels containing the larger amounts of Mn and Si.

TABLE 10

Tensile Properties of the Experimental Steels

| | Room Temperature Tests | | | | 650° C. Tests | | | |
|---|---|---|---|---|---|---|---|---|
| Steel | YS MPa | UTS MPa | T. E. (%) | ROA (%) | YS MPa | UTS MPa | T. E. (%) | OA (%) |
| V[a] | 734 | 819 | 20.3 | 77.0 | 453 | 476 | 22.7 | 84.6 |
| V1[a] | 880 | 965 | 17.4 | 70.9 | 502 | 521 | 26.8 | 84.4 |
| V6[b] | 979 | 1144 | 14.6 | 52.2 | 615 | 643 | 12.7 | 33.7 |
| V6A[c] | 790 | 871 | 17.7 | 76.0 | 490 | 509 | 22.1 | 79.6 |
| V6B[c] | 805 | 880 | 18.2 | 75.0 | 502 | 520 | 20.1 | 76.1 |
| V7[c] | 764 | 834 | 17.9 | 78.2 | 468 | 485 | 19.9 | 82.2 |
| V7A[c] | 833 | 938 | 18.7 | 69.0 | 504 | 527 | 20.9 | 80.3 |
| V8[c] | 854 | 969 | 17.7 | 78.1 | 508 | 527 | 20.7 | 82.2 |
| V8A[c] | 846 | 987 | 15.8 | 65.3 | 553 | 583 | 21.0 | 76.6 |
| V9[c] | 837 | 927 | 17.6 | 70.8 | 494 | 512 | 25.8 | 80.6 |
| VT[a] | 938 | 1064 | 17.8 | 60.8 | 540 | 553 | 13.7 | 72.2 |
| VT1[a] | 990 | 1114 | 17.5 | 62.4 | 564 | 603 | 22.7 | 74.2 |
| VT2[a] | 937 | 1027 | 18.3 | 70.8 | 552 | 591 | 20.5 | 77.0 |
| VT8[a] | 953 | 1044 | 17.6 | 71.3 | | | | |
| VT9[a] | 965 | 1078 | 14.6 | 58.9 | 587 | 628 | 16.3 | 60.6 |
| VT10[a] | 966 | 1077 | 17.2 | 68.1 | 586 | 620 | 18.4 | 78.0 |
| VT11[a] | 991 | 1110 | 16.4 | 65.7 | 602 | 640 | 17.6 | 76.9 |
| VT11A[b] | 930 | 1017 | 17.8 | 63.4 | 573 | 605 | 15.6 | 35.3 |
| VT11B[b] | 1010 | 1122 | 15.1 | 64.4 | 614 | 632 | 13.7 | 50.6 |
| VT12[a] | 975 | 1073 | 17.6 | 67.3 | 570 | 606 | 19.8 | 78.5 |
| VT12A[b] | 950 | 1046 | 15.5 | 57.2 | 563 | 580 | 10.2 | 35.2 |
| VT12B[b] | 975 | 1076 | 16.3 | 65.2 | 561 | 616 | 15.8 | 64.1 |
| VT13[b] | 918 | 1125 | 15.5 | 58.5 | 597 | 618 | 10.5 | 39.2 |

TABLE 10-continued

Tensile Properties of the Experimental Steels

| | Room Temperature Tests | | | | 650° C. Tests | | | |
|---|---|---|---|---|---|---|---|---|
| Steel | YS MPa | UTS MPa | T. E. (%) | ROA (%) | YS MPa | UTS MPa | T. E. (%) | OA (%) |
| VT14[b] | 1011 | 1186 | 14.0 | 63.5 | 670 | 714 | 13.3 | 47.0 |
| VT14B[c] | 1024 | 1198 | 15.2 | 62.4 | 674 | 722 | 15.1 | 63.4 |
| VH[a] | 948 | 1056 | 17.6 | 68.7 | 565 | 601 | 16.1 | 68.6 |
| VZ[a] | 902 | 992 | 17.6 | 72.2 | 509 | 531 | 17.5 | 76.6 |
| VZA[a] | 725 | 804 | 15.9 | 66.4 | 425 | 440 | 21.5 | 78.6 |

[a]1-lb VIM heat;
[b]20-lb AIM heat;
[c]20-lb VIM heat.

Figure 10:
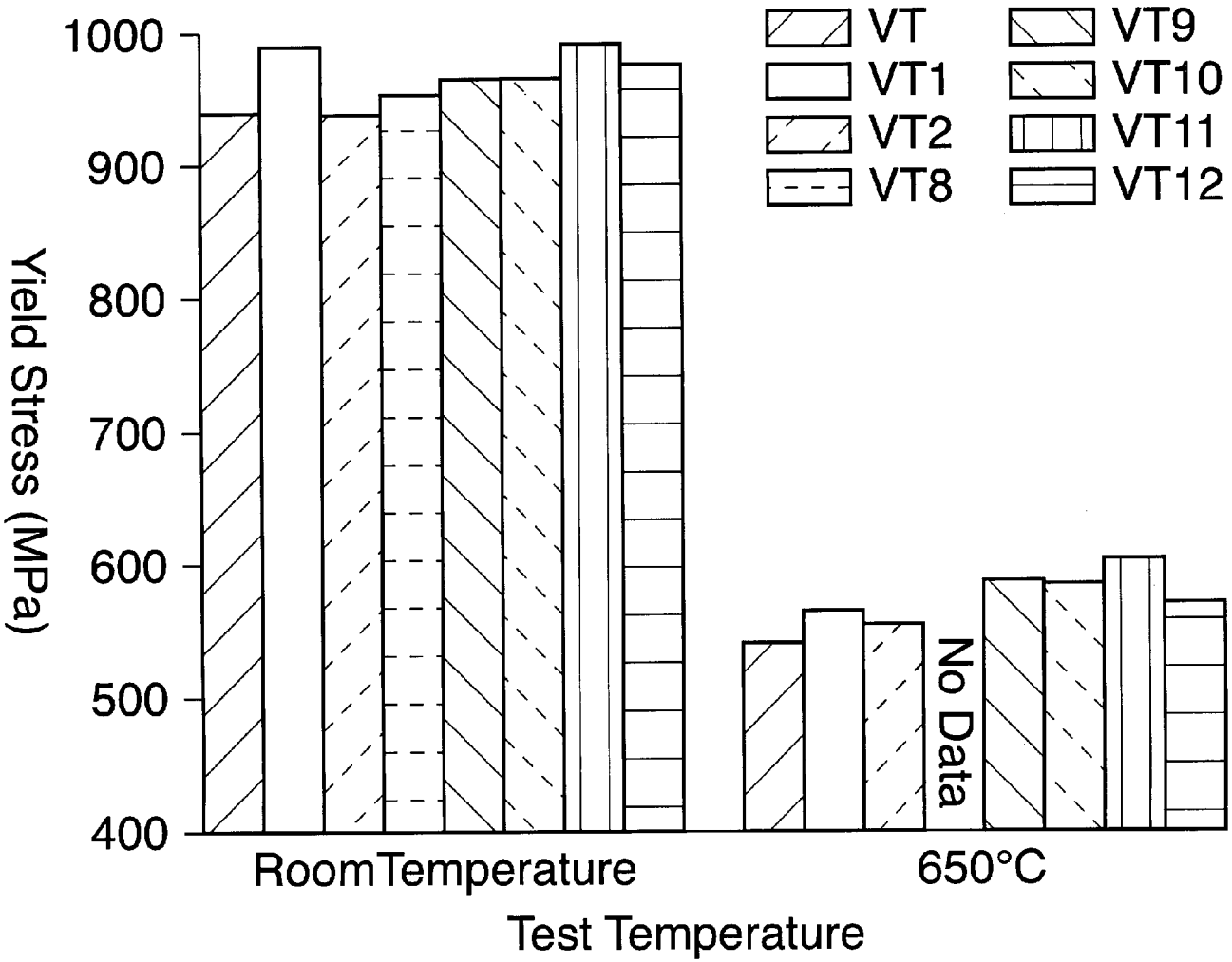
FIG. 10 is a graph of yield stress of 3Cr-3WVTa base (VT alloys) with compositional variations.

A second series of small heats of the VT (VT8–VT12) steels was prepared and tested as shown in FIG. 9 to examine the effect of Ta (VT8 and VT12), Mo (VT10 and VT11), and N (VT9). There was relatively little difference between the hardnesses, especially in the normalized-and-tempered condition, where the combination of 3.06% W and 0.83% Mo (VT11) showed an advantage over the other steels. The tensile tests verified that there was not much difference between the steels, as shown in FIG. 10. The VT11 had the highest strength (just slightly higher than VT1) of these steels. Except for the steel with the 0.02% N, it also had the lowest ductility, as shown in Table 10. FIG. 10 shows yield stress of 3Cr-3WVTa base (VT alloys) with compositional variations.

Results for 20-lb Heats

The first 20-lb heats that were studied were prepared by AIM, after which the VIM process became available, as shown in Table 8. For the V steels (no tantalum), only one AIM heat was melted along with several VIM heats. The yield stress shown in Table 10 for the V6 (AIM), V6A, V6B, V7, V7A, V8, and V9 (VIM) heats indicate that the AIM heat (V6) is clearly stronger than the VIM heats, as shown FIG. 11. The V6 steels contained 2.0% W, 0.75% Mo, the V7 and V8 steels contained 1.5% W, 0.75% Mo, and the V9 steel contained 3.0% W, 0% Mo. One possible reason the V6 steel was stronger may be the nitrogen in this heat. However, the increase in strength comes at the expense of ductility, as shown in Table 10. For the VIM heats there is little difference. The V7A and V8 appear somewhat stronger than the other VIM heats. These two steels contain more carbon (0.13–0.14%) than that of the other three steels (0.07–0.08%). The V8 also contains 0.008% B; this steel was stronger than V7A at room temperature, but there was no difference at 650° C. The relative change in the ultimate tensile strength was similar to that of the yield stress, as shown in Table 10. The ductilities of the VIM steels were also similar and considerably higher than that of the AIM heat (V6).

Figure 11:
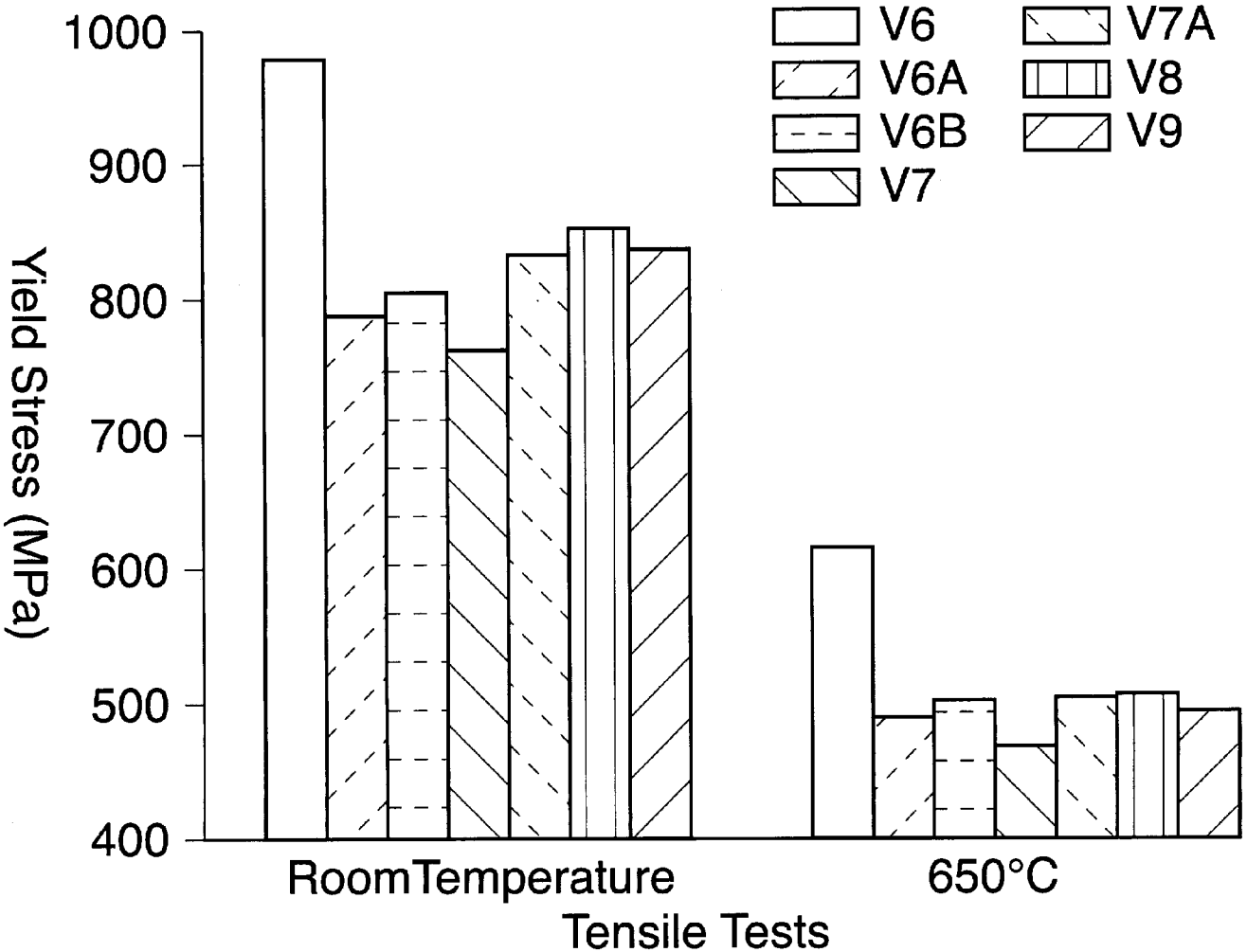
FIG. 11 is a graph of yield stress of 20-lb AIM (V6) and VIM heats of steel that do not contain tantalum (V steels).
Figure 12:
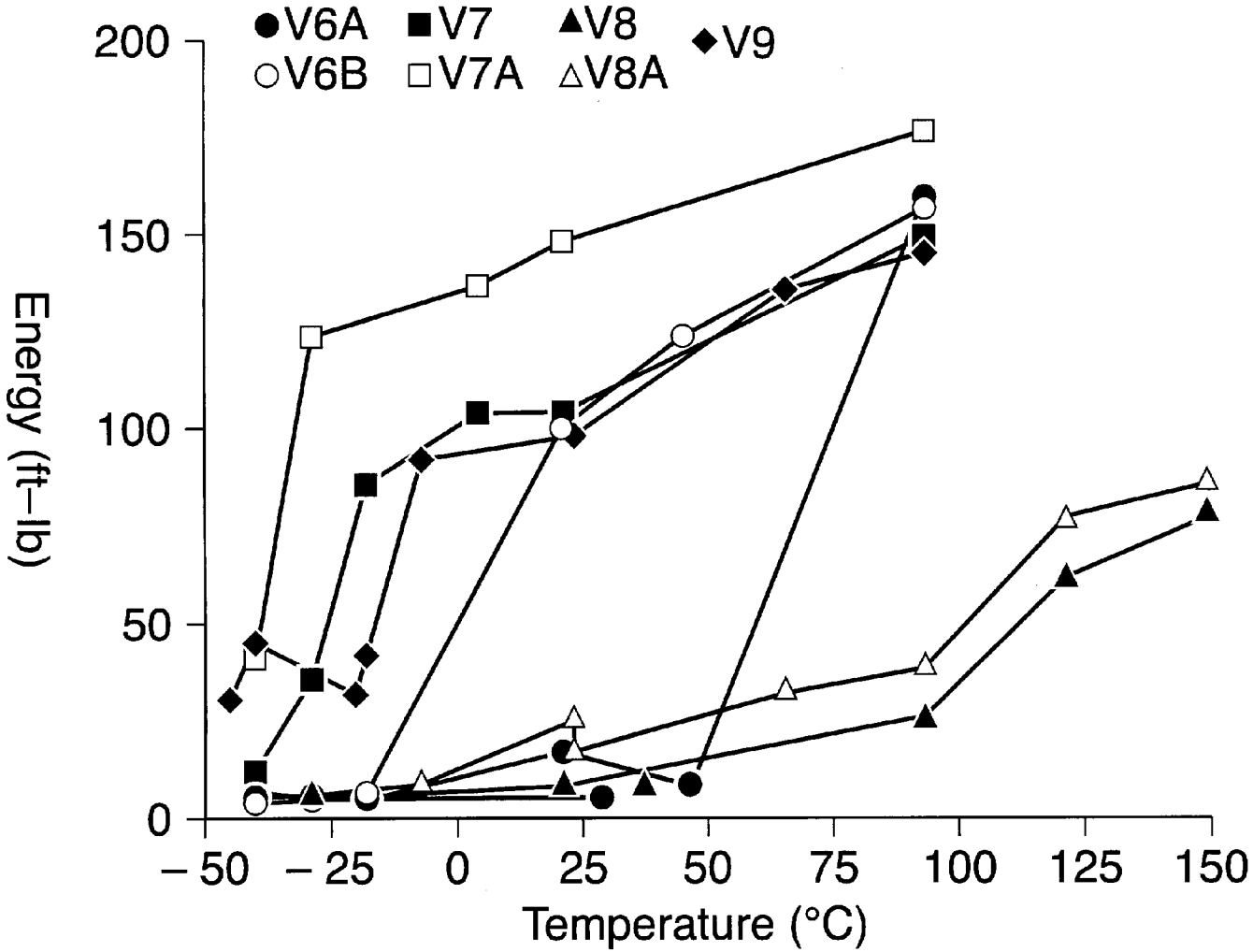
FIG. 12 is a graph of Charpy curves for 20-lb VIM heats of the V steels.

FIG. 12 shows the Charpy curves for the VIM V steels of FIG. 11. The V7, V7A, and V9 have similar curves, with the V7A having a slight advantage, although this steel contains slightly less carbon than the other two steels. The V6A and V6B have similar properties at the higher temperatures, but they are quite different at the lowest temperatures. This despite the fact these steels contained carbon levels even lower than V7A. The V7 and V7A steels contained 1.5% W, 0.75% Mo, the V6A and V6B steels contained 2.0% W, 0.75% Mo, and the V9 contained 3.0% W and no molybdenum, thus indicating again there may be an advantage to the combination of molybdenum and tungsten.

Figure 13:
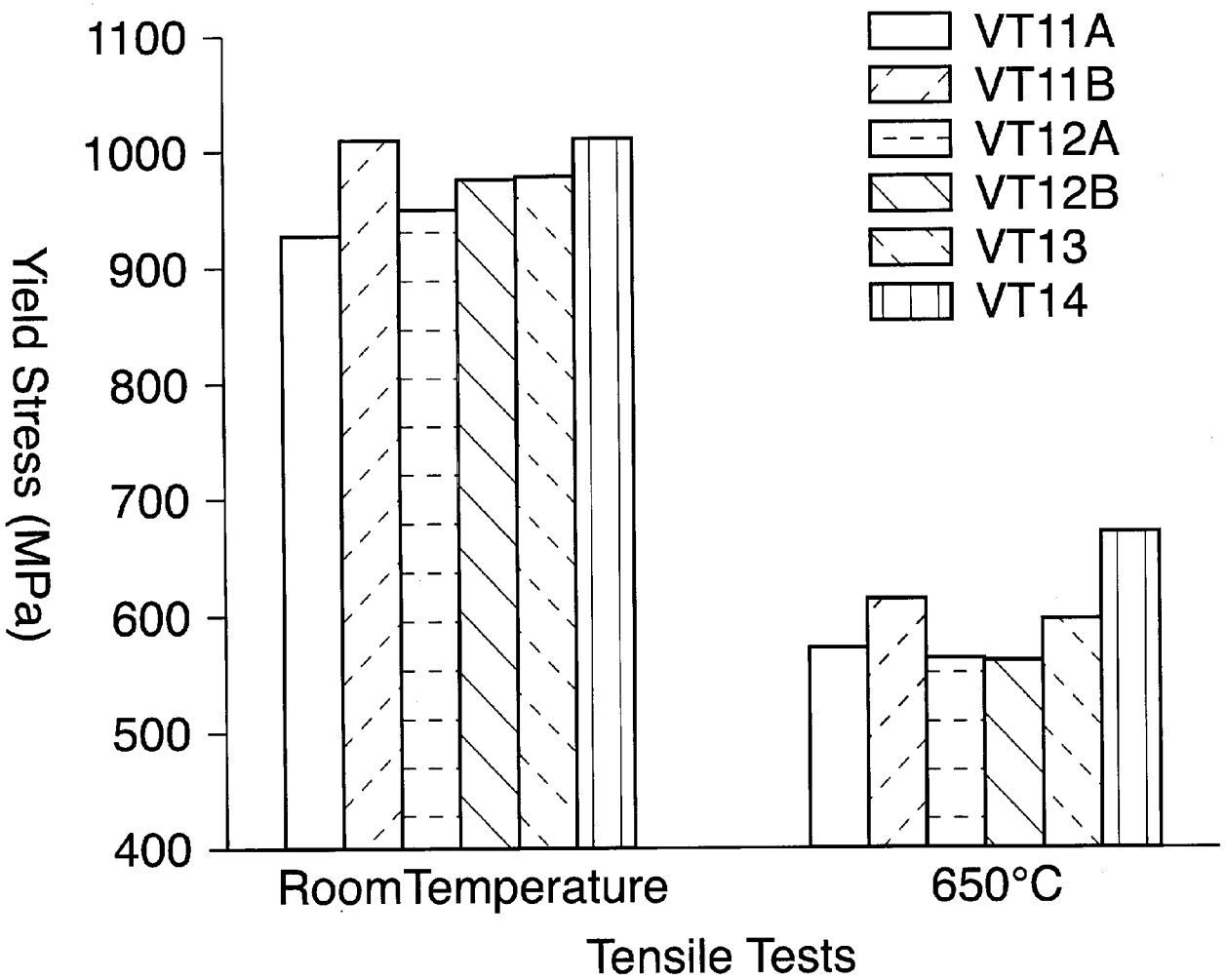
FIG. 13 is a graph of yield stress of 20-lb AIM heats of steel that contain tantalum (VT steels).

The first 20-lb heats produced for the VT steels were AIM heats VT11A, VT11B, VT12A, VT12B VT13, and VT14, as shown in Table 9. The yield stress of these steels showed only small variations, as shown in FIG. 13. At room temperature, VT11B was stronger than VT11A; the difference is due to the tantalum content, with the VT11B containing 0.10% Ta compared to 0.04% Ta for VT11A. A similar difference occurred for the VT12A and VT12B, where the tantalum concentrations were 0.04 and 0.13%, respectively. A comparison between VT11B and VT12B indicates that there is no benefit of the extra tantalum for the 0.13% Ta vs. 0.10% Ta. One other difference between the VT11A and B and the VT12A and B is that the former two contained 3% W and 0% Mo, whereas the latter two contained 2% W and 0.75% Mo. The indication that VT11B is somewhat stronger than VT12B, even though the latter has more tantalum, argues for a strengthening effect for the combination of molybdenum and tungsten. The VT 13 and 14 also contain 2% W and 0.75% Mo, and they are also stronger than the steels with just tungsten. The VT 14 also contained 0.01 B, and this steel was the strongest at both temperatures, even though it contained only 0.05 Ta. With the exception of the VT12B, however, the ductilities of these steels were quite low, especially compared to the 1-lb heats, as shown in Table 10. This is probably an effect of the AIM vs. VIM techniques used for the 20-lb and 1 lb heats, respectively.

FIG. 11 shows yield stress of 20-lb AIM (V6) and VIM heats of steel that do not contain tantalum (V steels) and FIG. 12 shows Charpy curves for 20-lb VIM heats of the V steels.

Figure 14:
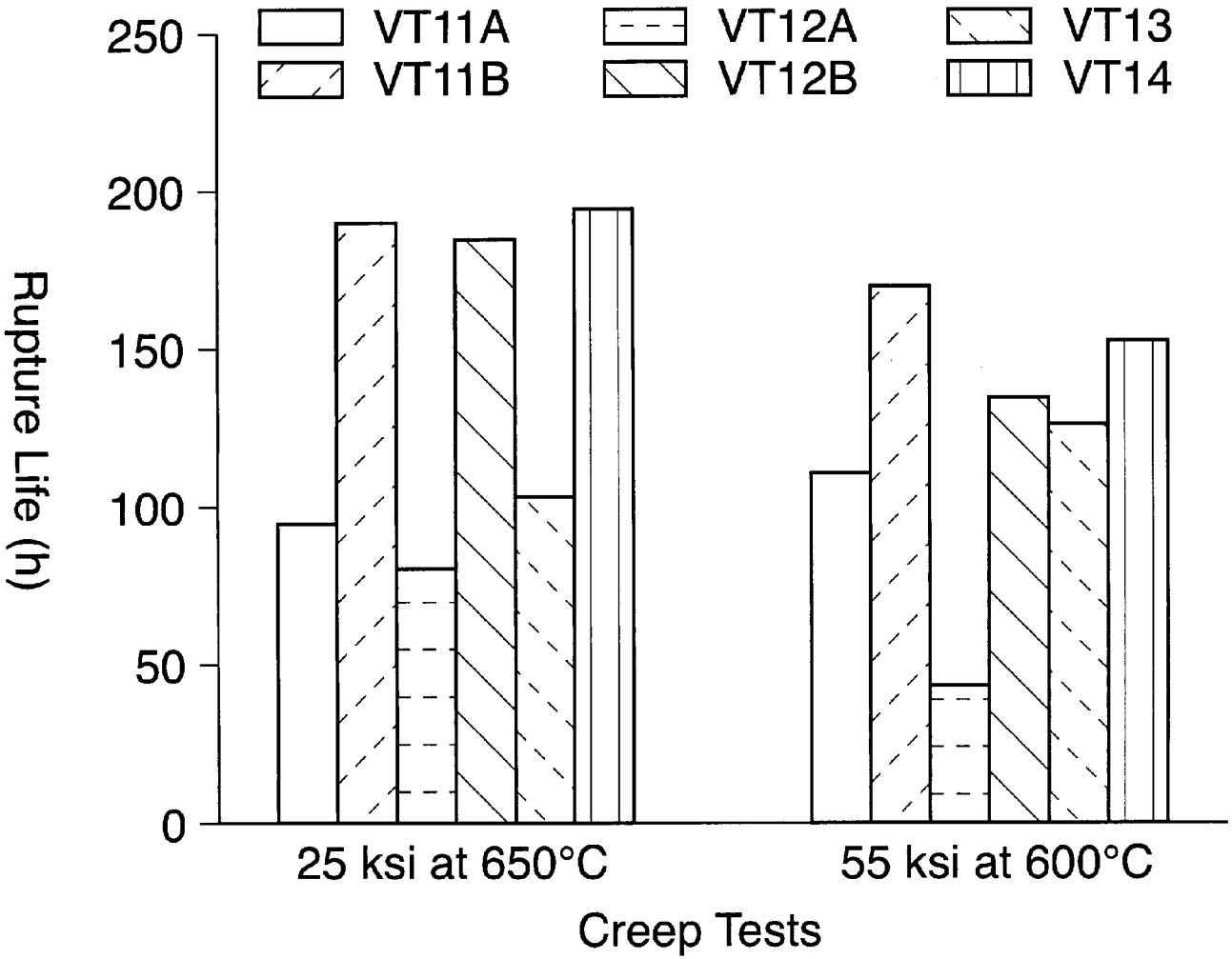
FIG. 14 is a graph of creep-rupture life of 20-lb AIM heats of steel that contain tantalum (VT steels).

FIG. 13 shows yield stress of 20-lb AIM heats of steel that contain tantalum (VT steels and FIG. 14 shows creep-rupture life of 20-lb AIM heats of VT steels.

The creep-rupture behavior as shown in FIG. 14 of the VT steels for tests at 25 MPa at 650° C. and 55 Mpa at 600° C. reflect the strength behavior, as shown in FIG. 13. The steels with the lowest tantalum and no boron (VT11A, VT12A, and VT 13) have the sbortest rupture lives. The addition of boron to the steel with only 0.05 Ta appears to compensate far the lower tantalum. There again appears to be a beneficial effect of the combination of molybdenum and tungsten as opposed to tungsten alone (compare VT11A and VT13 with VT12A).

Although the preferred product in many cases is a carbide-free acicular bainite, other useful austenite transformation products can be made in accordance with the present invention. General examples of austenite transformation products are ferrite, bainite, and martensite. Formation thereof generally depends on the cooling rate employed after the austenitizing temperature is reached.

The new alloy compositions of the present invention are useful as structural material for applications in the chemical, petrochemical, power generation, and steel industries. Advantages of using the alloys of the present invention include:

1. reduced thicknesses of components by as much as 50%;
2. potential for not requiring certain heat treatments such as, for example, tempering and/or post-weld heat treatment, which are highly energy intensive;
3. reduced component fabrication and welding time;
4. reduced use of welding consumables; and
5. reduced cost of component with improved performance.

The alloys of the present invention can be used to fabricate sundry articles that can benefit from the superior properties of the steel alloys described hereinabove. Articles can be formed by various forming methods, including, but not limited to: casting, forging, rolling, welding, extruding, machining, and swaging. Examples of articles that can be fabricated from the alloys of the present invention include, but are not limited to:

1. Heat exchange equipment and the like, for example: heat exchangers; feed water heaters; condensers; evaporators; coolers; re-boilers; surface steam condensers; fired heaters; furnaces; crackers; and related piping, tubing, fittings, expansion joints; valves and other pressure containment components used to connect heat exchange equipment and the like to other process equipment.
2. Columns, towers, and the like, for example: packed columns; tray columns; cracking towers; absorbing towers; drying towers; prill towers; coke drums; and related piping, tubing, fittings, valves and other pressure containment components used to connect columns, towers, and the like to other process equipment.
3. Pressure vessels, reactors, and the like, generally from 3/16 to 20 in. thick, 18 in. to 40 ft. in diameter and up to 300 ft long, including related piping, tubing, fittings, valves and other pressure containment components used to connect pressure vessels, reactors, and the like, to other process equipment.
4. Tanks, storage vessels, and the like, for example: flat bottom tanks; elevated storage tanks; bins; silos; pool liners; spheres; cryogenic, single wall vessels; cryogenic, double wall vessels; and related piping, tubing, fittings, valves, and other pressure containment components used to connect tanks, storage vessels, and the like to other process equipment.
5. Equipment for power production, for example: power boilers; heating boilers; electric boilers; hot water heaters; heat recovery steam generators; gas and steam turbines and associated components; generators and associated components; and related piping, tubing fittings, valves and other pressure containment components used to connect various pressurized components.
6. Equipment for metals production, for example: hoods; ladles; kettles; arc furnaces and continuous casting equipment components.
7. Piping, conduit, tubing, and the like of sundry sizes and configurations, for wall thickness; and tubing from ½" outside diameter to 16" outside diameter and 0.049" to 3" wall thickness.
8. Valves and valve components of sundry sizes and configurations, from very small to very large (50 to 150,000 lbs).
9. Welding electrodes, for example, wire, strips, rods, and the like of sundry sizes and configurations.

While there have been shown and described what is at present considered the preferred embodiment of the invention, it will be obvious to those skilled in the art that various changes and modifications may be made therein without departing from the scope of the invention as defined by the appended claims.

What is claimed is:

1. A high-strength, high-toughness wrough steel composition comprising:

about 2.5% to about 4% chromium, about 1.5% to less t 2.15% tungsten, about 0.1% to about 0.5% vanadium, about 0.2% to about 1.5% manganese, and from 0.50% molybdenum to the lesser of 1.0% molybdenum and ½ (3.5%—said weight % of said tungsten), and about 0.05% to 0.25% carbon with the balance being iron, wherein the percentages are by total weight of the composition, and wherein a yield strength (YS) at room temperature of said steel is from 805 to 1024 MPa.

2. A wrought steel composition in accordance with claim 1 wherein a microstructure of said steel comprises carbide-free acicular bainite.

3. A wrought steel composition in accordance with claim 1 further comprising 0.07% to about 0.25% tantalum.

4. A wrought steel composition in accordance with claim 1 wherein an ultimate tensile strength (UTS) at room temperature of said steel is from 938 to 1198 MPa.

5. A wrought steel composition in accordance with claim 1 further comprising up to about 0.08% nitrogen.

6. A wrought steel composition in accordance with claim 1 further comprising up to about 0.2% hafnium.

7. A wrought steel composition in accordance with claim 1 further comprising up to about 0.2% zirconium.

8. A wrought steel composition in accordance with claim 1 further comprising up to about 0.25% niobium.

9. A wrought steel article in accordance with claim 1 further comprising up to about 01% titanium.

10. A wrought steel composition in accordance with any one of claims 1-3, 4, 5-8 and 9, inclusive, wherein said steel alloy is formed into an article.

11. A wrought steel article in accordance with claim 10 wherein said article comprises at least one of the group consisting of heat exchange equipment, column, tower, tank, storage vessel, pressure vessel, reactor, piping, tubing, valve, valve component, expansion joint, and welding material.

12. A method of producing a high-strength, high-toughness wrought steel composition comprising the steps of:

a. forming a wrought body of a ferritic steel composition comprising about 2.5% to about 4% chromium, about 5% to less than 2.15% tungsten, about 0.1% to about 0.5% vanadium, about 0.2% to about 15% manganese, about 0.05% to 0.25% carbon, and from 0.50% molybdenum to the lesser of 0.1% molybdenum and ½ (3.5%—said weight % of said tungsten) with the balance being iron, wherein the percentages are by total weight of the composition;

b. heating said wrought body to an austenitizing temperature for a predetermined length of time; and c. cooling said wrought body from said austenitizing temperature at a rate to form an austenite transformation microstructure, wherein a yield strength (YS) at room temperature of said steel is from 805 to 1024 MPa.

13. A method in accordance with claim 12 wherein said austenite transformation microstructure comprises a carbide-free acicular bainite microstructure.

14. A method in accordance with claim 12 wherein said austenitizing temperature is at least 1100° C. and said predetermined length of time is at least 0.25 hour.

15. A method in accordance with claim 12 wherein said heating step further comprises heating said wrought body in a medium selected from the group consisting of air, vacuum, and an inert atmosphere.

16. A method in accordance with claim 12 wherein said heating step further comprises air cooling said wrought body after heating.

17. A method in accordance with claim 12 wherein said cooling step comprises quenching said wrought body in a liquid after heating.

18. A method in accordance with claim 12 wherein an ultimate tensile strength (UTS) at room temperature of said steel is from 938 to 1198 Mpa.

19. A high-strength, high-toughness wrought steel composition comprising:

about 2.5% to about 4% chromium, about 1.5% to less than 2.15% tungsten, about 0.1% to about 0.5% vanadium, about 0.2% to about 1.5% manganese, and from 0.50% molybdenum to the lesser of 1.0% molybdenum and ½ (3.5%—said weight % of said tungsten), and about 0.05% to 0.25% carbon with the balance being iron, wherein the percentages are by total weight of the composition, wherein an ultimate tensile strength (UTS) at room temperature of said steel is from 938 to 1198 MPa.

20. A wrought steel composition in accordance with claim 19 wherein a microstructure of said steel comprises carbide-free acicular bainite.

21. A wrought steel composition in accordance with claim 19 further comprising 0.07% to about 0.25% tantalum.

22. A wrought steel composition in accordance with claim 19 further comprising up to about 0.08% nitrogen.

23. A wrought steel composition in accordance with claim 19 further comprising up to about 0.2% hafnium.

24. A wrought steel composition in accordance with claim 19 further comprising up to about 0.2% zirconium.

25. A wrought steel composition in accordance with claim 19 further comprising up to about 0.25% niobium.

26. A wrought steel article in accordance with claim 19 further comprising up to about 0.2% titanium.

27. A wrought steel composition in accordance with any one of claims 19–26, inclusive, wherein said steel alloy is formed into an article.

28. A wrought steel article in accordance with claim 27 wherein aid article comprises at least one of the group consisting of heat exchange equipment, column tower, tank, storage vessel, pressure vessel, reactor, piping, tubing, valve, valve component, expansion joint, and welding material.

* * * * *

UNITED STATES PATENT AND TRADEMARK OFFICE

CERTIFICATE OF CORRECTION

PATENT NO. : 7,074,286 B2
APPLICATION NO. : 10/323194
DATED : July 11, 2006
INVENTOR(S) : Klueh et al.

It is certified that error appears in the above-identified patent and that said Letters Patent is hereby corrected as shown below:

On Title Page

Item (54), delete "Wrought" before --CR-W-V--.

In the claims:

Claim 1, column 18, line 25, replace "t" with --than--
Claim 9, column 18, line 51, replace "01%" with --0 2%--.
Claim 12, column 18, line 65, replace "5% with --1.5%--
Claim 12, column 18, line 66, replace "15%" with --1.5%--
Claim 12, column 19, line 1, replace "0.1% with --1.0%--.
Claim 28, column 20, line 28, replace "aid" with --said--.
Claim 28, column 20, line 29, after "column" add --.--.

Signed and Sealed this

Twenty-sixth Day of September, 2006

JON W. DUDAS
*Director of the United States Patent and Trademark Office*